US005290965A

United States Patent [19]

Yoshida et al.

[11] Patent Number: 5,290,965

[45] Date of Patent: Mar. 1, 1994

[54] ASYNCHRONOUS WAVEFORM GENERATING DEVICE FOR USE IN AN ELECTRONIC MUSICAL INSTRUMENT

[75] Inventors: Kiyoshi Yoshida; Kiyoshi Hagino, both of Hamamatsu, Japan

[73] Assignee: Yamaha Corporation, Hamamatsu, Japan

[21] Appl. No.: 673,765

[22] Filed: Mar. 20, 1991

[30] Foreign Application Priority Data

Mar. 20, 1990 [JP] Japan ..... 2-70261

[51] Int. Cl.[5] ..... G10H 7/04

[52] U.S. Cl. ..... 84/605; 364/723; 364/724.02

[58] Field of Search ..... 84/607, 604, 605, 603, 84/601, 606; 364/723, 724.02

[56] References Cited

U.S. PATENT DOCUMENTS

| | | | |
|---|---|---|---|
| 4,246,823 | 1/1981 | Wachi et al. . | |
| 4,561,337 | 12/1985 | Wachi | 84/604 |
| 4,612,838 | 9/1986 | Nagashima et al. | 84/607 |
| 4,785,706 | 11/1988 | Toshifumi | 84/606 |
| 4,901,615 | 2/1990 | Matsushima et al. | 84/605 |
| 4,916,996 | 4/1990 | Suzuki et al. . | |

FOREIGN PATENT DOCUMENTS 60-63593 4/1985 Japan .

*Primary Examiner*—William M. Shoop, Jr.
*Assistant Examiner*—Brian Sircus
*Attorney, Agent, or Firm*—Graham & James

[57] ABSTRACT

A waveform generating device applicable to musical tone generating circuitry employed in electronic musical instruments is disclosed. The device digitally stores sampled waveform data. The data is read out and the musical tone having a different pitch is generated according to a pitch-sampling rate asynchronous system. The device includes a storing device which stores sampled waveform data, pitch designation device which outputs a signal indicating the pitch of a musical tone to be generated, readout device which successively reads out the waveform data at a speed which is determined based on the signal, an interpolation device which creates intermediate data, corresponding to a value which exists between two continuous sample data which are read out by device of the readout device, by means of interpolation calculation, and outputs the intermediate data at a fixed sampling cycle, a beginning readout designation device which designates beginning of readout in the readout device, and a readout speed control device, which sets readout speed of the readout device to a faster speed than the speed determined based on the pitch signal for a predetermined period following the designation of the beginning of readout by the beginning readout designation device.

18 Claims, 14 Drawing Sheets

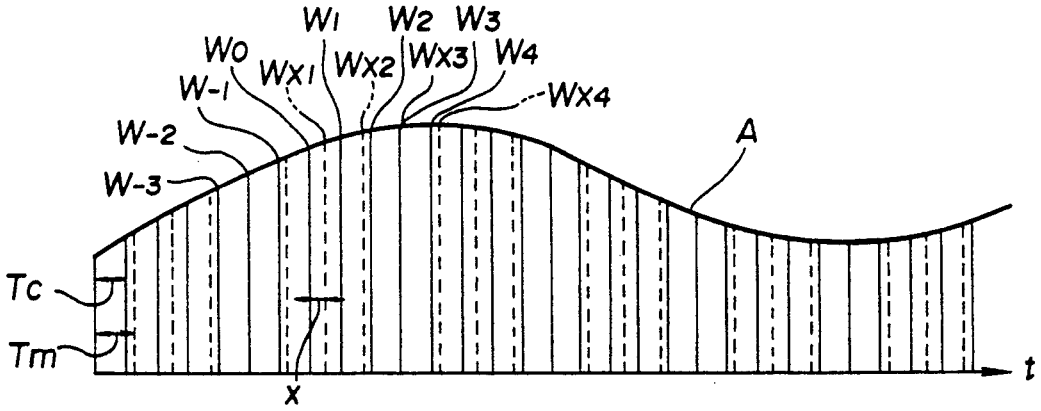
FIG.1(a) *(PRIOR ART)*

ASYNCHRONOUS WAVEFORM GENERATING DEVICE FOR USE IN AN ELECTRONIC MUSICAL INSTRUMENT

BACKGROUND OF THE INVENTION

1. Field of the Invention

The present invention relates to waveform generating devices, and more particularly, to waveform generating devices applicable to musical tone generating circuitry employed in electronic musical instruments, and the like.

2. Prior Art

Electronic musical instruments are conventionally known wherein the tone generating circuitry incorporates digital waveform memory, on which basis timbre control is effected with these devices, digital waveform data which has been previously recorded in waveform memory is output serially therefrom at a sampling rate which corresponds to the desired pitch of the musical tone to be produced. Accordingly, pitch control is achieved through varying the sampling rate at which digital waveform data is output from waveform memory. In this way, a digital signal is created which has timbre characteristics corresponding to the waveform data output from waveform memory and a pitch corresponding to the rate at which digital waveform data is output from waveform memory.

Examples of this type of waveform generating device include that disclosed in Japanese Patent Application Laid-Open No. Sho-60-63593, and that disclosed in Japanese Patent Application Laid-Open No. Sho-62-242995. In the first of the above referenced Japanese patent applications, a device is disclosed wherein waveform data which has been compressed by DPCM (differential pulse code modulation) encoding and serially recorded in waveform memory can be subsequently read from the waveform memory and decompressed via a corresponding decoding process so as to regenerate the originally stored waveform data, in this way effectively increasing the storage capacity of a given amount of waveform memory. Similarly, Japanese Patent Application Laid-Open No. Sho-62-242995 discloses a device wherein waveform data is compressed using differential modulation, then stored in waveform memory. Thus, in both of the above-described conventional devices, compressed waveform data which has been stored in waveform memory is later read out therefrom and decompressed when regeneration of the corresponding timbre is desired.

With the devices of both of the above cited Japanese patent applications, in response to operation of keys on a keyboard, or signals from various other types of input parameter generating means, the rate at which waveform data is read out from waveform memory is appropriately adjusted in each tone generating element in operation, on which basis the pitch of the individual tone produced in each tone generating element is controlled. Systems of this type wherein pitch is directly controlled by varying the sampling rate at which waveform data is read out from waveform memory are generically referred to as synchronous waveform generating devices. In the case of synchronous waveform generating devices such as those of the above cited Japanese patent applications, because the generation of two or more musical tones having differing pitches involves sampling waveform data at differing sampling rates, considerable complexity is introduced into the design of subsequent signal processing devices such as D/A converters, effectors etc., and the interface therewith. This increase in complexity is especially marked in the case of polyphonic systems.

As a means to circumvent the above-described difficulties, the use of asynchronous waveform generating devices has been implemented. With asynchronous waveform generating devices, in addition to the waveform data values stored in waveform memory, intermediate waveform data values become available through application of interpolation techniques to groups of consecutive waveform data values stored in waveform memory. Thus, although waveform data values are stored in waveform memory at consecutive integral memory addresses, in effect, output of interpolated waveform data values corresponding to hypothetical nonintegral memory address becomes possible. As a result, readout of waveform data from waveform memory can be carried out at a predetermined sampling rate independent of the pitch of the musical tone to be produced, thereby making it possible to carry out subsequent processing at the constant sampling rate.

With both synchronous and asynchronous waveform generating devices, the waveform data values stored in waveform memory is originally generated by sampling the original musical tones at a fixed sampling rate $R_c$ (this fixed sampling rate $R_c$ is the mathematical invervse of a fundamental sampling interval hereafter referred to as fundamental sampling interval $T_c$). This is illustrated in FIG. 1(*a*) for a fundamental waveform A of an original musical tone, wherein the horizontal axis represents time, and the interval between each adjacent pair of solid vertical lines corresponds to fundamental sampling interval $T_c$.

In contrast to synchronous generating waveform devices, however, with an asynchronous waveform generating device, interpolated waveform data values corresponding to waveform data values from the hypothetical sampling of the original musical tone at a sampling rate $R_m$ (different from fundamental sampling rate $R_c$, this sampling rate $R_m$ is the mathematical invervse of a sampling interval hereafter referred to as regeneration sampling interval $T_m$) are output at the fundamental sampling rate $R_c$. When a regeneration sampling interval $T_m$ has a duration greater than that of fundamental sampling interval $T_c$, as indicated, for example, by the broken vertical lines seen in FIG. 1(*a*), output of consecutive waveform data values at the fundamental sampling rate $R_c$ will result in a pitch higher than that of the original musical tone, as is shown in FIG. 1(*b*), the regeneration waveform B of the regeneration musical tone having a pitch equal to the frequency of fundamental waveform A multiplied by sampling ratio $\alpha(=T_m/T_c)$.

It is commonly the case, however, that the sampling ratio $\alpha$ is not an integral value, in other words, regeneration sampling interval $T_m$ is frequently not an integral multiple of fundamental sampling interval $T_c$. As a result, in order to implement the use of the above-described type of asynchronous waveform generating device, it becomes necessary to include a means to interpolate the sampled data corresponding to points which are integral multiples of fundamental sampling interval $T_c$, to thereby obtain waveform data corresponding to points which are integral multiples of regeneration sampling interval $T_m$. With the asynchronous waveform generating devices described thus far, an interpolating circuit is employed, wherein multiple interpolation calculations are performed using the data stored in waveform memory. More specifically, for each sampling data value to be calculated which corresponds to an integral multiple of regeneration sampling interval $T_m$ on the time axis, an interpolation operation is carried out wherein sampling data values corresponding to multiples of fundamental sampling interval $T_c$ in proximity to the point for which the interpolation operation is to be carried out are supplied to the interpolating circuit, whereupon calculations are carried out so as to arrive at the interpolated waveform data value.

As a concrete example of the above described interpolation operations, consider the sample waveform A shown in FIG. 1(*a*). To determine the sampling data value corresponding to the single point $W_{x1}$ on the time axis shown in the figure, 6th order interpolation is carried out using the sampling data values correlating with points $W_{-3}$, $W_{-2}$, $W_{-1}$, $W_0$, $W_1$, $W_2$ and $W_3$ on the time axis, where $W_{-3}$, $W_{-2}$, $W_{-1}$ and $W_0$ are the four multiples of fundamental sampling interval $T_c$ immediately prior to $W_{x1}$ with respect to time, and where $W_1$, $W_2$ and $W_3$ are the three multiples of fundamental sampling interval $T_c$ immediately after $W_{x1}$ with respect to time. Thus, the sampling data values corresponding to these points on the time axis are read out from waveform memory and supplied to the interpolating circuit. In the interpolating circuit, for each of the seven points, a corresponding interpolation coefficient is calculated based on the phase difference x between $W_{x1}$ and $W_0$, from which the waveform data value corresponding to point $W_{x1}$ is obtained. This process is then repeated to determine the sampling data value corresponding to the single point $W_{x2}$ on the time axis, this time carrying out the interpolation operation using the sampling data values correlating with points $W_{-2}$, $W_{-1}$, $W_0$, $W_1$, $W_2$, $W_3$ and $W_4$ on the time axis, where $W_{-2}$, $W_{-1}$, $W_0$ and $W_1$ are the four multiples of fundamental sampling interval Tc immediately prior to $W_{x2}$. The and where $W_2$, $W_3$ and $W_4$ are the three multiples of fundamental sampling interval Tc immediately after $W_{x2}$. The interpolation process as thus described is repeated over and over, thereby determining waveform data values corresponding to $W_{x1}$, $W_{x3}$, $W_{x4}$, $W_{x5}$, $W_{x6}$, . . . which are consecutive multiples of regeneration sampling interval Tm. When the calculated waveform data values thus obtained are then consecutively output at fundamental sampling rate $R_c$, waveform B shown in FIG. 1(*b*) is produced, having a frequency which is higher than that of fundamental waveform 1 shown in FIG. 1(*a*) by a factor equal to ratio $T_m/T_c$, that is, by a factor equal to sampling ratio $\alpha$.

With the waveform processing thus described, although actual waveform data values are sequentially stored in waveform memory at consecutive integral memory addresses, interpolation calculations are carried out in response to hypothetical fractional addresses. By sequentially summing the value of sampling ratio $\alpha$, these memory addresses can be successively obtained. With the consecutive fractional values thus obtained, the integral portions thereof can be used as memory addresses at which actual waveform data values used for interpolation calculations are stored, whereas from the fractional portions thereof, the above-described interpolation coefficients can be obtained for each sampling data value which is employed in interpolation calculations. An asynchronous waveform generating device implementing this method has been disclosed in Japanese Patent Publication No. Sho-59-17838.

For this conventional asynchronous waveform generating device, however, in proportion to the order of interpolation carried out, the number of sampling data values which must be read out from waveform memory for the first interpolation calculation increases. As a result, a significant delay can result between the time a tone generation command is given and the time the tone is actually generated. Particularly, when pitch data $\alpha$ is a relatively small value, the phase data values obtained by sequentially summing pitch data $\alpha$ increase at a very slow rate, which results in poor response characteristics.

SUMMARY OF THE INVENTION

In consideration of the above, it is an object of the present invention to provide a waveform generating device which can regenerate a large number of freely selectable waveforms representing various timbres (tone colors), the pitch of each waveform thus regenerated being freely selectable, the waveform generating device having a very fast response time.

So as to achieve the above-described object, the present invention provides:

storing means which stores sampled waveform data, pitch designation means which outputs a signal indicating the pitch of a musical tone to be generated, readout means which successively reads out said waveform data at a first speed which is determined based on the signal, interpolation means which creates intermediate data between two continuous sample data read out by means of said readout means, by means of interpolation calculation, and outputs the interpolation data at a predetermined sampling cycle, beginning readout designation means which designates beginning of readout in said readout means, and readout speed control means, which sets readout speed of said readout means to a second speed independent of said first speed for a predetermined period following the designation of the beginning of readout by said beginning readout designation means, whereby time lag caused by said interpolation calculated becomes small.

DETAILED DESCRIPTION OF THE PREFERRED EMBODIMENTS

First Preferred Embodiment

In the following, the waveform generating device of a first preferred embodiment of the present invention will be described with reference to the figures.

Figure 1B:
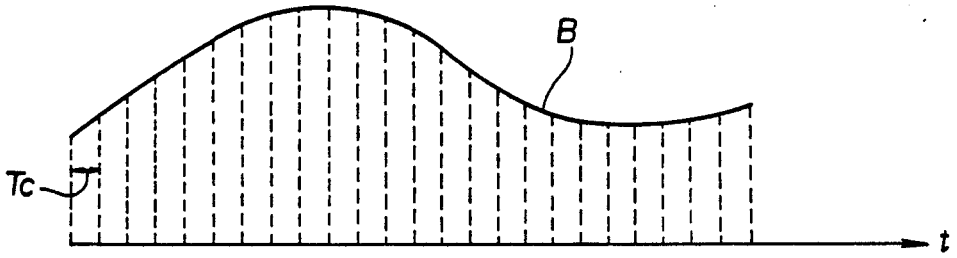
FIG.1(b)(PRIOR ART)
FIGS. 1(*a*) and 1(*b*) are waveform diagrams included for the purpose of illustrating interpolation calculations carried out in a conventional synchronous waveform generating device.
Figure 2:
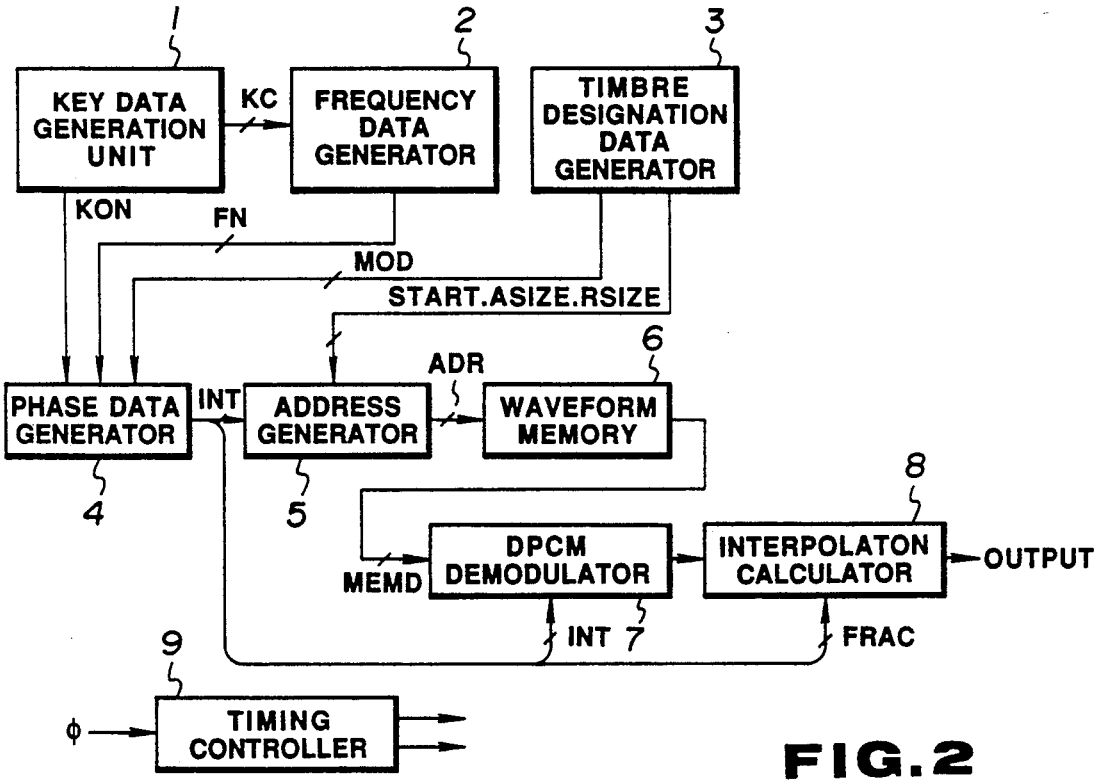
FIG. 2 is a block diagram illustrating the overall layout of a waveform generating device in accordance with a first preferred embodiment of the present invention.

The device of the present embodiment, as shown in the block diagram FIG. 2, may be suitably applied as a tone generating unit for electronic musical instruments, and the like. In the figure, a key data generation unit 1 can be seen which generates various signals in response to operation of a keyboard (not shown), or other type of input device. When a keyboard is employed as the input device, operation of a key thereon results in the generation of a key code KC which indicates which key has been depressed, and a key-on signal KON which indicates the fact that a key has been depressed. As FIG. 2 shows, key codes KC are supplied to a frequency data generator 2, wherein based on the key code KC supplied thereto, pitch data FN is generated and supplied to a phase data generator 4. This pitch data FN is equivalent to $T_m/T_c$, that is, the ratio of the regeneration sampling interval $T_m$ to the fundamental sampling interval $T_c$ which were previously described. The values for pitch data FN output from frequency signal generator 2 are generated based on a data table stored in ROM (Read Only Memory) which is not shown in FIG. 2. This data table consists of a series of data values, each of which designates a corresponding value of pitch data FN for each key code KC.

A timbre designation data generator 3 can be seen in FIG. 2, which, in response to activation of a timbre designating operator (not shown), generates starting address data START, attack size data ASIZE, and repeat size data RSIZE corresponding to the designated timbre. The timbre designation data generator 3 of the waveform generating device of the present embodiment can additionally implement an FM (frequency modulation) waveform generator, whereby other more complex waveforms can be produced. In such a case, timbre designation data generator 3 also provides pitch modulation code MOD data as an output signal thereof. The various output signals of timbre designation data generator 3 will later be described in further detail.

Based on key-on signals KON, pitch data FN and pitch modulation code data MOD supplied thereto, phase data generator 4 generates phase data which indicates the phase component corresponding to a given sampling point, this phase data made up of an integral portion and a fractional portion. The integral portion of each phase data value generated in phase data generator 4 is supplied to an address generator 5, wherein the readout address ADR for corresponding waveform data in waveform memory 6 is produced and output. Each available timbre in the waveform generating device is represented by sampling data for the corresponding fundamental waveform which is stored in waveform memory 6.

Figure 3:
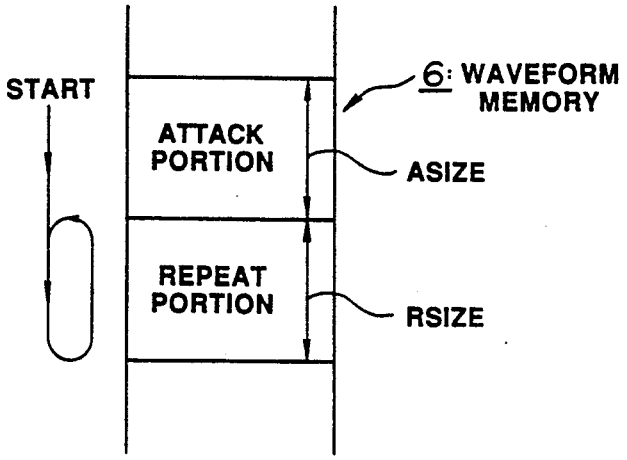
FIG. 3 illustrates a data structure used for storing waveform data in the waveform generating device shown in FIG. 2.

FIG. 3 illustrates a data structure according to which sampling data for each fundamental waveform is stored in waveform memory 6. As the figure shows, this data structure contains starting address data START, attack size data ASIZE, and repeat size data RSIZE for the corresponding waveform. Starting address data START indicates the address at which waveform data for a given waveform begins. This given waveform has a timbre which is determined by the timbre controls. Attack size data ASIZE indicates the length of the attack portion (the number of addresses included in the attack portion). Repeat size data RSIZE indicates the length of the repeat portion (the number of addresses included in the repeat portion). Furthermore, the waveform data of this corresponding waveform are recorded by means of a DPCM code, which is the difference between each waveform value and the immediately preceding waveform value. By means of this type of encoding, memory space can be saved in waveform memory 6.

DPCM demodulator 7, which is shown in FIG. 2, demodulates the waveform values based on a series of DPCM codes read out from waveform memory 6. This demodulation operation is controlled based on the integral portion INT of the phase data. Interpolation calculator 8 uses the series of waveform values outputted from DPCM demodulator 7 and the interpolation coefficients determined by the fractional portion FRAC of the phase data to conduct interpolation calculation, and outputs the results of this calculation as the waveform data to be regenerated. A standard clock $\phi$ supplied by an oscillation circuit, not shown in the diagram, is inputted into timing controller 9, and the detection signals from each part of the waveform generation apparatus are also inputted; and based on this, timing signals which control each part are generated.

Hereinbelow, the composition of each part of the waveform generation apparatus described above will be described in detail.

COMPOSITION OF PHASE DATA GENERATOR 4

Figure 4:
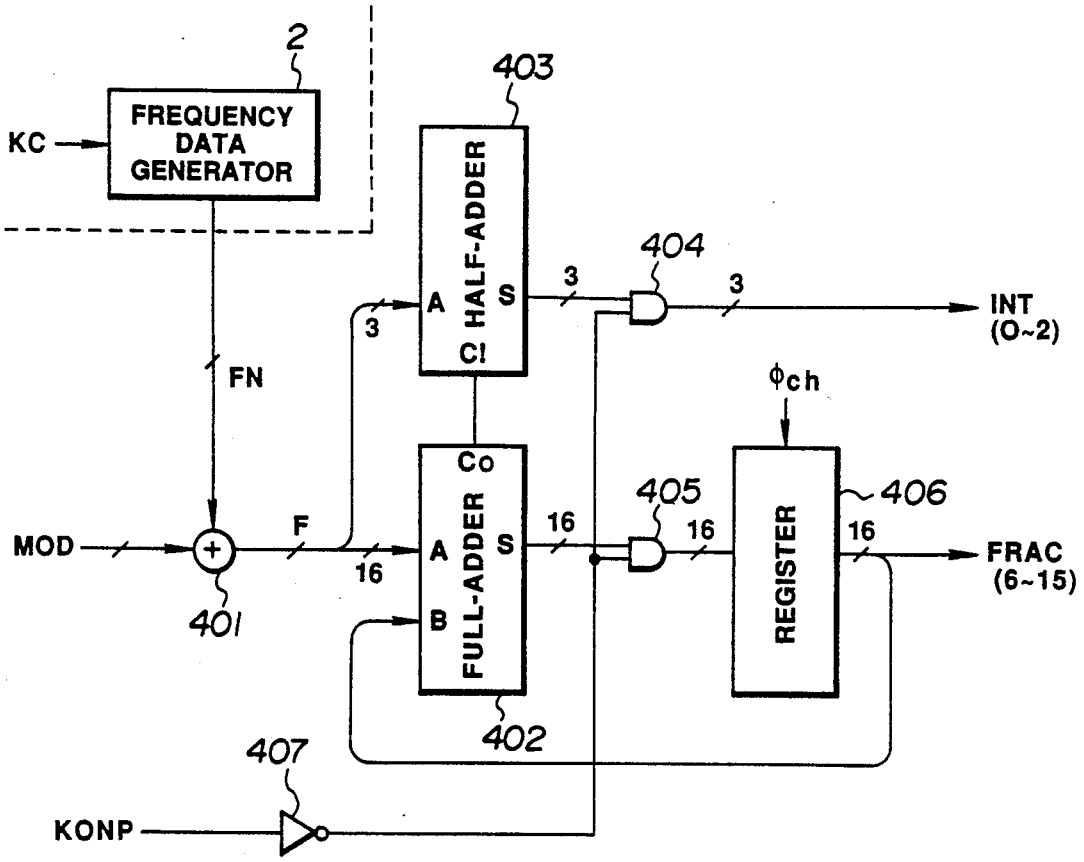
FIG. 4 is a block diagram illustrating the overall layout of a phase data generating circuit employed in the waveform generating device shown in FIG. 2.

FIG. 4 is a block diagram showing the composition of phase data generator 4. In the diagram, pitch data FN and pitch modulation signal MOD are inputted into adder 401, and readout pitch data F, which determine the readout pitch of the waveform, are outputted. When pitch modulation signal MOD changes, the readout period of the waveform data from waveform memory 6 changes in response to this, and as a result, frequency modulation of the musical tone is carried out. Pitch data F comprises an integral part (the upper 3 bits) and a fractional part (the lower 16 bits). This fractional part is provided to full adder 402 as receiving-addition input A, and the integral part is provided to half-adder 403. Carry output CO of full adder 402 is supplied to carry input CI of half-adder 403.

The addition result (16-bit) of full adder 402 is supplied to one of the input terminals of 16-bit composition AND gate 405. The addition output (3-bit) of half-adder 403 is supplied to one input terminal of 3-bit composition AND gate 404. The output of inverter 407 is supplied to the other input terminal of AND gates 404 and 405. This inverter 407 inverts and outputs the fixed-period key-on pulse KON which has a value of "1" when a key is depressed.

The output of AND gate 404 is supplied to address generator 5 as integral part INT of the phase data. The output of AND gate 405 is synchronized with clock $\phi$ch which is generated by timing controller 9, and is registered in register 406 and supplied to full adder 402 as receiving addition input B. The data maintained in register 406 are supplied to interpolation calculator 8 as the fractional part FRAC (16-bit) of the phase data.

In accordance with a phase data generator 4 with this type of construction, when a key-on pulse KONP is generated by means of the depression of a key, the integral part INT of the phase data becomes 0, and the fractional part FRAC of the phase data which is maintained in register 406 is cleared. After this, fractional portions FRAC of pitch data FN are synchronized with clock $\phi$ch and the accumulated addition of these fractional portions FRAC is carried out by full adder 402 and register 406 and an integer part INT and a fractional part FRAC of the phase data corresponding to this accumulated value are generated.

COMPOSITION OF ADDRESS GENERATOR 5 AND TIMING CONTROLLER 9

Figure 5:
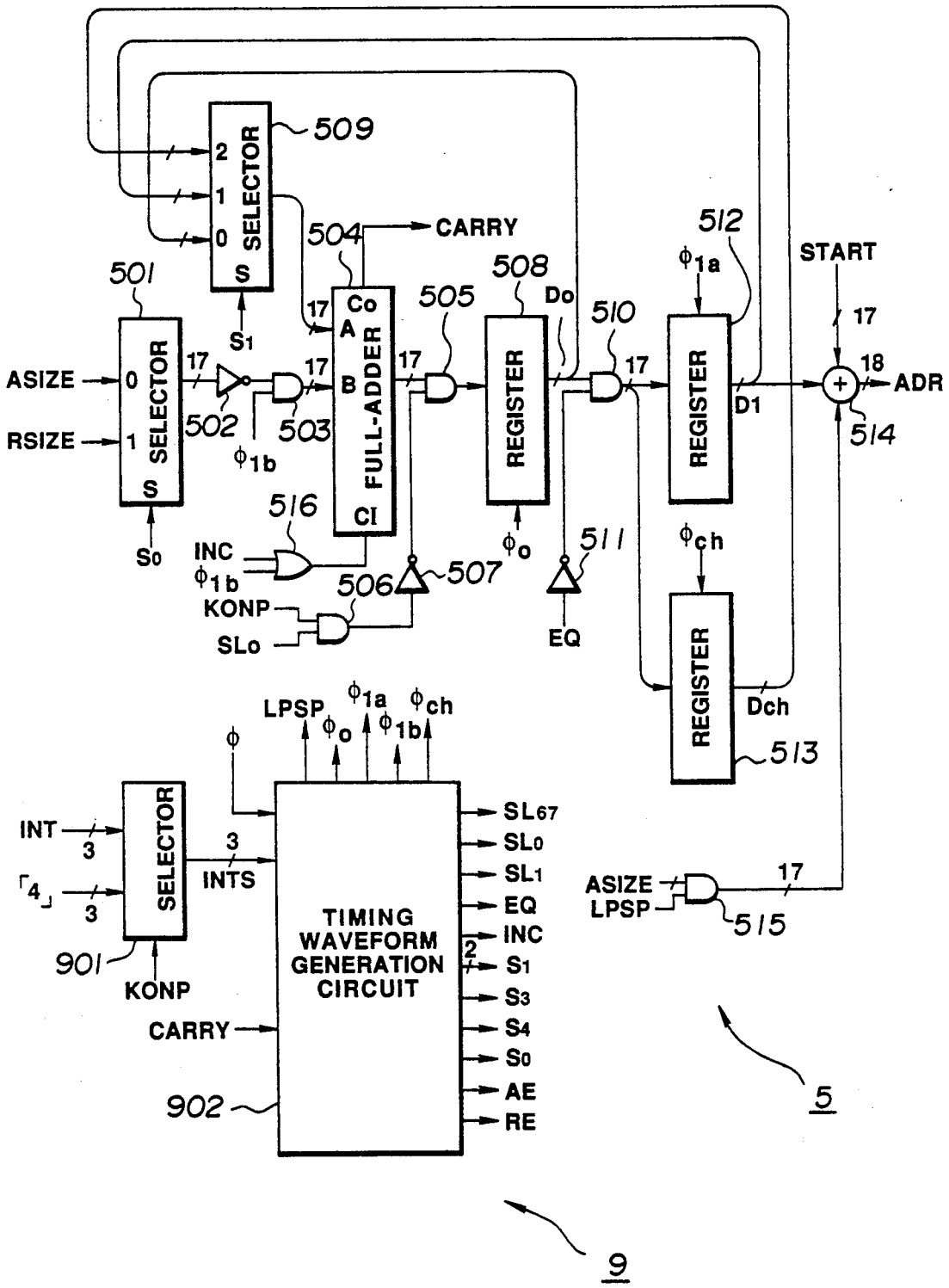
FIG. 5 is a block diagram illustrating an address generating circuit and timing controller employed in the waveform generating device shown in FIG. 2.

FIG. 5 is a block diagram showing the composition of address generator 5 and timing controller 9. Integral part INT of the phase data is supplied to the zeroth input port of selector 901 of timing controller 9, and a fixed data 4 is supplied to the first input port thereof, and key-on pulse KONP is supplied to the selector terminal. The data selected by selector 901 are inputted into timing waveform generation circuit 902 as address generation control data INTS. In addition to address generation control data INTS, the detection signals outputted by address generator 5 and standard clock $\phi$ are supplied to timing waveform generation circuit 902, and based on these signals a timing signal is generated as described hereinafter.

Figure 6:
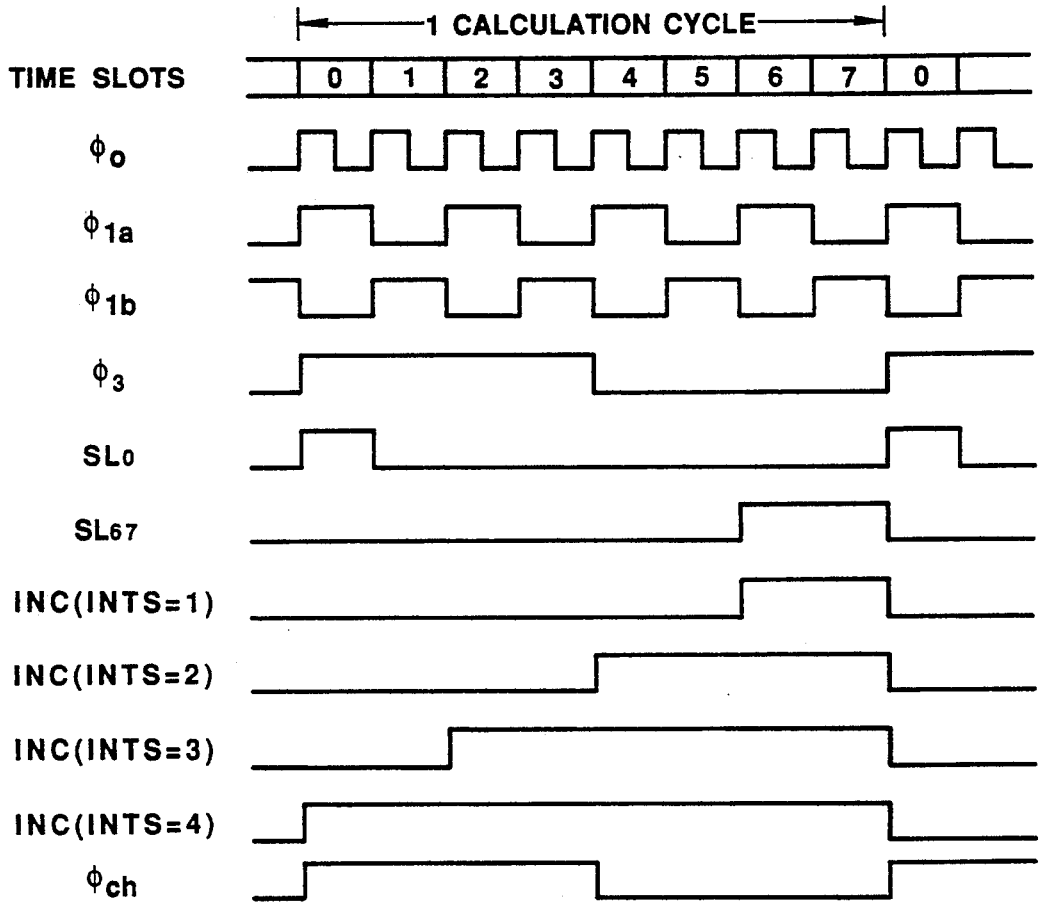
FIG. 6 is a waveform diagram illustrating various timing signals employed in the waveform generating device shown in FIG. 2.

An example of a timing signal outputted from timing waveform generation circuit 902 is shown in FIG. 6. The clock $\phi$0 shown in the diagram is obtained by the division of the standard clock $\phi$. Furthermore, clock $\phi$1*a*, $\phi$1*b*, $\phi$3 and $\phi$ch are obtained by the division of the clock $\phi$0. In the wave form generation apparatus according to the present preferred embodiment, interpolation calculation is carried out for one sampling portion synchronously with clock $\phi$ch. Accordingly, in the following explanation, the cycle of clock $\phi$ch is termed the calculation cycle. In one calculation cycle, clock $\phi$O begins 8 times. The period from the first beginning of this clock $\phi$O to the second beginning thereof is termed the zeroth slot. Hereinafter, each period from one beginning of $\phi$O to the next beginning, is termed the first slot, the second slot, . . . to the seventh slot. That is, the slots from the zeroth slot to the seventh slot make up one calculation cycle.

Slot signal SLO is a signal which has the value of 1 only during the period of the zeroth slot in the calculation cycle. In addition to this, each slot signal SLn (n=1 to 7), which show which slot the current point in time corresponds to, are generated and supplied to each part. Slot signal SL67 is a signal which has a value of 1 only in the period of the sixth and seventh slots. Clock 100 1*a* has a value of 1 during a period of even numbered slots while Clock $\phi$1*b* has a value of 1 only during the period of odd numbered slots. Increment signal INC is a control signal for the renewal of the waveform addresses in address generator 5 which will be discussed hereinafter. This increment signal INC controls the waveform corresponding to data INTS outputted from the selector 901. That is to say, increment signal INC has a value of 1 during the period of the sixth and seventh slots in the case where INTS equals 1. Increment signal INC has a value of 1 in the periods of the fourth through seventh slots in the case where INTS equals 2. Increment signal INC has a value of 1 between the periods of the second to the seventh slots in the case where INTS equals 3, and the signal INC has a value of 1 during the periods of the zeroth to the seventh slots in the case where INTS equals 4.

Attack size data ASIZE are supplied to the zeroth input port of selector 501 of address generator 5 which is shown in FIG. 5. Repeat size data RSIZE are supplied to the first input port thereof, and select data SO, which are generated by timing generation circuit 902, are supplied to the select terminal thereof. The data selected by selector 501 are supplied to inverter 502. The output of inverter 502 is supplied to one of the input terminals of AND gate 503. Clock $\phi$1*b* is supplied to the other input terminal of this AND gate 503. The output of AND gate 503 is sent to full adder 504 as receiving addition input 503. Clock $\phi$1*b* and increment signal INC are inputted into OR gate 516. The output of OR gate 516 is sent to full adder 504 as carry input CI. Carry output signal CARRY which is outputted from the carry output terminal CO of full adder 504 is supplied to timing waveform generation circuit 902. This carry output signal CARRY is, in odd numbered slots of each calculation cycle, assorted in the case in which the address which is to be supplied to a waveform memory 6 exceeds the final address of the attack portion, or in the case in which the address which is to be supplied to waveform memory 6 exceeds the final address of the repeat portion. In both of these cases, an equality detection signal EQ is outputted from timing waveform generation circuit 902. Furthermore, timing waveform generation circuit 902 outputs an attack end detection signal AE in the case in which the address which is to be supplied to waveform memory 6 exceeds the final address of the attack part, and timing waveform generation circuit 902 outputs a repeat end detection signal RE in the case in which the address which is to be supplied to the waveform memory 6 exceeds the final address of the repeat part. The operation of the detection of these attack ends and repeat ends will be explained hereinafter.

The addition result outputted from full adder 504 is supplied to one input terminal of AND gate 505. Furthermore, key-on pulse KONP and slot signal SLO are sent to AND gate 506. The output of AND gate 506 is inverted by inverter 507 and supplied to the other input terminal of AND gate 505. The output of AND gate 505 is made synchronous with clock $\phi$0 and registered in register 508. The output data D0 of register 508 and the output of inverter 511 are supplied to AND gate 510. Inverter 511 inverts the equality detection signal EQ outputted from timing waveform generation circuit 902 and outputs this as a signal. The output of AND gate 510 is registered in register 512 by clock $\phi 1a$ and registered in register 513 by clock $\phi$ch.

Output data D0 of selector 508 are inputted into the zeroth input port of selector 509. The output data D1 of selector 512 are inputted into the first input port thereof and the output data DCH of selector 513 are inputted into the second input port thereof. The data selected by selector 509 are sent to full adder 504 as receiving addition input A. Attack size data ASIZE and repeat signal LPSP are inputted into AND gate 515. In the case in which the regeneration of the repeat part has begun, repeat signal LPSP is assorted by timing waveform generation circuit 902. Accordingly, during the period in which the regeneration of the attack part is being conducted, the data 0 is outputted from AND gate 515, while on the other hand, during the period in which the regeneration of the repeat part is being conducted, attack size data ASIZE is outputted from AND gate 515. The output of AND gate 515, the output data D1 of register 512, and start address data START are inputted into adder 514, and the addition result thereof is supplied to waveform memory 6 as waveform readout address data ADR.

COMPOSITION OF DPCM DEMODULATOR D7 AND INTERPOLATION CALCULATOR 8

Figure 7:
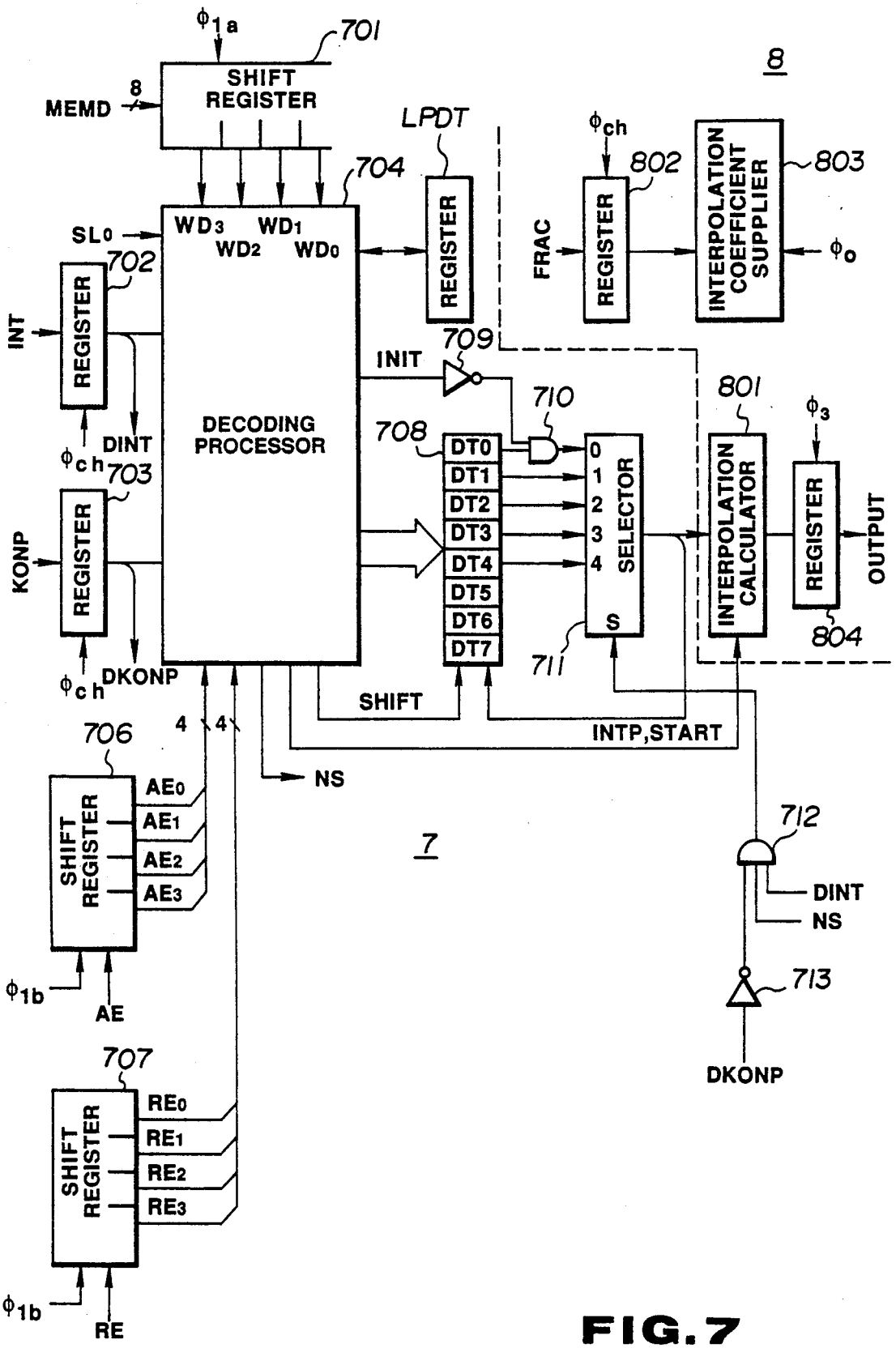
FIG. 7 is a block diagram illustrating a differential pulse code modulator (DPCM) and interpolator employed in the waveform generating device shown in FIG. 2.

FIG. 7 is a block diagram showing the composition of DPCM demodulator D7 and interpolation calculator 8. The waveform data MEMD of the DPCM code read out from waveform memory 6 are synchronized with clock $\phi 1a$ and successively registered and shifted in shift register 701. The outputs of each of the first through fourth stages of shift register 701 are registered in registers WD3 to WD0 of decoding processor 704. Data DINT and data DKONP are supplied to decoding processor 704. This data DINT is the integral part INT of the phase data delayed by one calculation cycle by register 702. Furthermore, data DKONP is key-on pulse KONP delayed by one calculation cycle by means of register 703. Attack end detection signal AE is made synchronous with clock $\phi 1b$ and registered and successively shifted in shift register 706. Repeat end detection signal RE is synchronized with clock $\phi 1b$ and registered and successively shifted in shift register 707. The decoding processor 704 conducts the determination of the slot number in which the attack end is detected, by means of referring to the output data AE0 to AE3 of the first to fourth stages of shift register 706. Furthermore, a determination of the slot number detected by the repeat end is made in decoding processor 704 by referring to output data RE0 to RE3 of the first to fourth stages of shift register 707.

The final demodulated waveform value of the attack part is written in loop data register LPDT by decoding processor 704. In the case in which the repeat end has been detected, DPCM demodulation is carried out based on the demodulated waveform value within this loop data register LPDT. Register 708 has 8 data areas DT0 to DT7; and each data is written therein and each shift between data areas is controlled by the decoding processor 704. The data maintained in data area DT0 are sent to one input terminal of AND gate 710. The data maintained in data areas DT1 to DT4 are sent to the first to the fourth input ports of selector 711. Initializing signal INIT outputted by decoding processor 704 is inverted by inverter 709 and this is sent as a signal to the other input terminal of AND gate 710. The output of AND gate 710 is sent to the zeroth input port of selector 711. Output data DKONP of register 703 are inverted by inverter 713 and this signal and switching signal NS outputted by decoding processor 704 as well as output data DINT of register 702 are supplied to AND gate 712. The output of AND gate 712 is sent to selector 711 as select data. The output of selector 711 is sent to interpolation calculator 801 of interpolation calculator 8 as a DPCM demodulated interpolation waveform value, and sent to data area DT7 of register 708.

In interpolation calculator 8, fractional part FRAC of the phase data are delayed by 1 calculation cycle by means of passing through register 802, and are inputted into interpolation coefficient supplier 803. Then, an interpolation coefficient consisting of 8 parts corresponding to fractional part FRAC, is synchronized with clock $\phi$O and successively supplied from interpolation coefficient supplier 803 to interpolation calculator 801. In interpolation calculator 801, the waveform values supplied successively through the medium of selector 711 are multiplied by the corresponding interpolation coefficients and the accumulated addition of the results of the multiplication is carried out. Then, by means of the carrying out of the accumulated addition necessary for one calculation cycle, the interpolation calculation of one waveform value is completed, and the results of the calculation are synchronized with clock $\phi$O and registered in register 804, then sent to the D/A switcher which is connected thereto.

Next, the operation of a waveform generation apparatus having this type of composition will be explained. In this waveform generating device, the operational state of the timbre controls is detected by timbre designation data generator 3, and a start address data START and attack size data ASIZE, as well as a repeat size data RSIZE, which correspond to the timbre (tone color) designated by means of these controls, are supplied to address generator 5. Furthermore, in the case of timbre (tone color) which necessitates frequency modulation, pitch modulation signal MOD is supplied to phase data generator 4.

In this state of timbre designation, when one of the keys of a keyboard is pressed, the key code data KC and the key-on signal KON of this key are outputted from key data generation unit 1. Key code data KC are registered in frequency data generator 2, while key-on signal KON is registered in phase data generator 4. Then, a pitch data FN, which corresponds to the key code data KC, is outputted from frequency generator 2 and supplied to phase data generator 4. Furthermore, by means of the beginning of the key-on signal KON, key-on pulse KONP acquires a value of 1 for the period of one calculation cycle by means of timing controller 9.

Next, in phase data generator 4, pitch data FN and pitch modulation signal MOD are added, this is synchronized with the switching of the calculation cycle, and the accumulation of the fractional part of readout pitch data F is carried out. The value of the accumulated addition of the fractional part of readout data F is supplied to interpolation calculator 8 as fractional part FRAC of the pitch data. The intergral part INT of the phase data resulting from the addition of the integral of readout pitch data F and the carry output of the accumulated addition of the fractional part of readout pitch data F is determined and then supplied to address generator 5 and DPCM demodulator 7.

OPERATION OF ADDRESS GENERATOR 5

Figure 8:
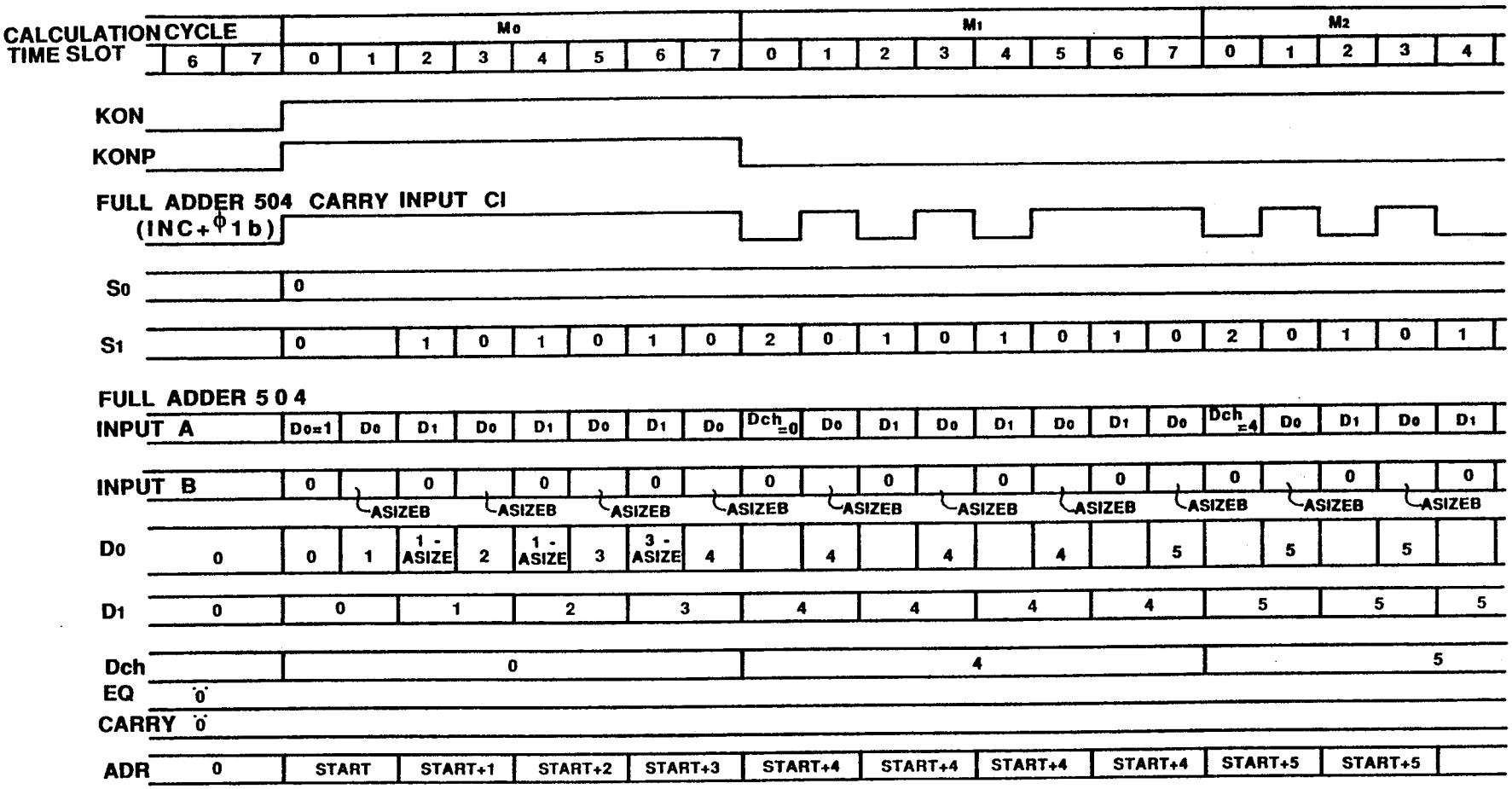
FIGS. 8 through 11 are time charts illustrating the operation of the address generating circuit employed in the waveform generating device shown in FIG. 2.

When key-on signal KON and key-on pulse KONP are assorted, the operation shown in the time chart of FIG. 8 begins in address generator 5. In this diagram, the operation of a case in which the integral part INT of the phase data is 1 is shown.

When key-on pulse KONP begins, and in the period until the beginning of the regeneration of the repeat part, select data SO is set to 0, and repeat signal LPSP is set to 0 by timing waveform generation circuit 902. Equality detection signal EQ is maintained at 0 as long as the attack end or the repeat end have not been detected. Furthermore, in the period of calculation cycle MO in which key-on pulse KONP is maintained at 1, a fixed value 4 is selected by a selector 901 (INTS=4) and in all slots, the increment signal is 1. As a result, carry input CI of full adder 516 becomes 1. Select data S1 in calculation cycle MO is 0 in the zeroth and the first slots, and in following slots, it has a value of 1 in even numbered slots and a value of 0 in odd numbered slots.

In the zeroth slot of calculation cycle MO, KONP equals 1 and SLO equals 1, so that the output of AND gate 505 becomes 0. In addition, the output of AND gate 505 is written into register 508 by means of clock $\phi$O and the output data D0 of register 508 becomes 0. As a result of this, the output of AND gate 510 becomes 0. The output of AND gate 510 is written into register 512 by means of clock $\phi$1*a* and written into register 513 by means of clock $\phi$ch so that the data maintained in each register is such that D1 equals 0 and $\phi$ch equals 0.

In the zeroth slot of calculation cycle MO, select data S has a value of 0, so that a data D0 which equals 0 is inputted into full adder 504 as receiving addition input A. Furthermore, as the value of clock $\phi$1*b* is 0, the receiving addition input B of full adder 504 becomes 0. As a result, 1 is outputted from full adder 504 as the result of this addition.

When the first slot is reached, the result of addition 1 in full adder 504 is registered in register 508 and D0 has a value of 1. Furthermore, the value of clock $\phi$1*b* becomes 1, and all bits of the attack size data ASIZE which were selected by selector 501, are inverted by inverter 502 and this data ASIZEB is inputted into full adder 504 through the medium of AND gate 503 as receiving addition input B. At this time, a data D0 having a value of 1 is inputted into full adder 504 as receiving addition input A, and 1 is inputted into full adder 504 as carry input CI, so that the subtraction which is carried out is effectively 1−ASIZE. In the case in which the results of this subtraction are less than 0, that is, the case in which D0 is greater than or equal to ASIZE, carry signal CARRY is assorted. Usually, ASIZE has a value considerably greater than 1, and in such a case, carry signal CARRY would not be assorted.

Next, when the second slot is reached, the output of register 508, D0, having a value of 1, is written into register 512 at this point by clock $\phi$1*a* (D1=1). Then, the subtraction result 1−ASIZE which is outputted by full adder 516 is written into register 508 by means of clock $\phi$0. The value of clock $\phi$1*b* becomes 0, so that the receiving addition input B of full adder 504 becomes 0. Furthermore, select data S1 becomes 1, and output data D1 of register 512 having a value of 1 is inputted into full adder 504 as receiving addition input B. As a result of this, an addition result of 2 is outputted from full adder 504.

Next, when the third slot is reached, operation identical to that of the first slot is carried out, and the addition result 2 of full adder 504 is registered into register 508 and data D0 acquires a value of 2 so that a subtraction result 2−ASIZE is outputted from full adder 504. After this, operation of the same type as that described above is carried out and the maintenance data D1 of register 512 increases to 2 in the fourth slot and increases to 3 in the sixth slot. Furthermore, at the odd numbered fifth and seventh slots, a determination is made as to whether the maintenance data D0 of register 508, which are to be registered in register 512 in the following even numbered slot, are greater than ASIZE or not.

In this way, in the initial calculation cycle nO in which key-on pulse KONP is assorted, increment signal INC is assorted in all slots. Therefore, data consisting of maintenance data of register 512, to which 1 has been added, are written into register 508 4 times (in the first, third, fifth, and seventh slots), and one slot after each of these, maintenance data D0 of register 508 are written into register 512. Maintenance D1 of register 512 are added to start address data START by adder 514 and the addition result START +D1 is supplied to waveform memory 6 as waveform readout address ADR.

From the next calculation cycle M1 onwards, select data $S_1$ have a value of 2 in the zeroth slot while in the odd numbered slots after this, these data have a value of 0, and in even numbered slots after this, they have a value of 1.

When calculation cycle M1 is reached, the maintenance data D0 of register 508, which have a value of 4, are written into register 512 by means of clock $\phi$1*a* and written into register 513 by means of clock $\phi$ch, so that the maintenance data of each register become D1 with a value of 4, and $\phi$ch with a value of 4, and waveform readout address ADR acquires a value of START+4. In calculation cycle M1, key-on pulse KONP has a value of 0 so that the integer portion (equals 1) of the phase data is supplied to timing waveform generation circuit 902 as address generation control data INTS. Accordingly, in response to this data INTS (equals 1), increment signal INC, having a value of 1 in the sixth and seventh slots only, is generated by timing waveform generation circuit 902. As a result, the carry input CI of full adder 504 becomes 1 in the first, third, and fifth through seventh slots.

First in the zeroth slot of calculation cycle M1, maintenance data DCH of register 513 having a value of 4 is inputted into full adder 504 as receiving addition input A. At this time, carry input CI has a value of 0, and receiving addition input A has a value of 0 so that the addition result of full adder 504 becomes 4. Then, this addition result is written into register 508 in the following first slot. When the second slot is reached, maintenance data D0 of register 508 having a value of 4 is written into registers 512 and 513 and maintenance data D1 of register 512 having a value of 4 is inputted into full adder 504 as receiving addition input A. However, as carry input CI has a value of 0 in this case, the addition result in full adder 504 is 4 and in the following third slot, a value of 4, which is exactly equal to the value at the preceding time (the first slot), is written in register 508. Next, the maintenance data 4 of register 508 is written into register 512 in the fourth slot. In this way, during the period in which increment signal INC has a value of 0, the maintenance data of registers 508 and 512 is not incremented, and accordingly, the waveform memory address ADR, which is supplied to waveform memory 6, does not change (in this case, it maintains a value of START+4).

Then, when the sixth slot is reached, increment signal INC acquires a value of 1. By means of this, the addition results of full adder 504 becomes 5. Next, in the seventh slot, a value of 5 is written into register 508, and 1 slot later, in the zeroth slot of calculation cycle M2, a value of 5 is written into registers 512 and 513. Then, the value of START+5 is supplied to waveform memory 6 as waveform readout address ADR.

If, for example, the integral part INT of the phase data has a value of 2, carry input CI of full adder 504 has a value of 1 in the fourth slot, and the data of registers 508 and 512 would be incremented. As a result, waveform readout address ADR is incremented. That is, from calculation cycle M2 onward, the waveform readout address ADR is incremented with the frequency of the value of the integral part INT of the phase data. From calculation cycle M2 onwards, as in the case of calculation cycle M1, a determination is made as to whether the maintenance data D0 of register 508 are greater than ASIZE in odd numbered slots.

Figure 9:
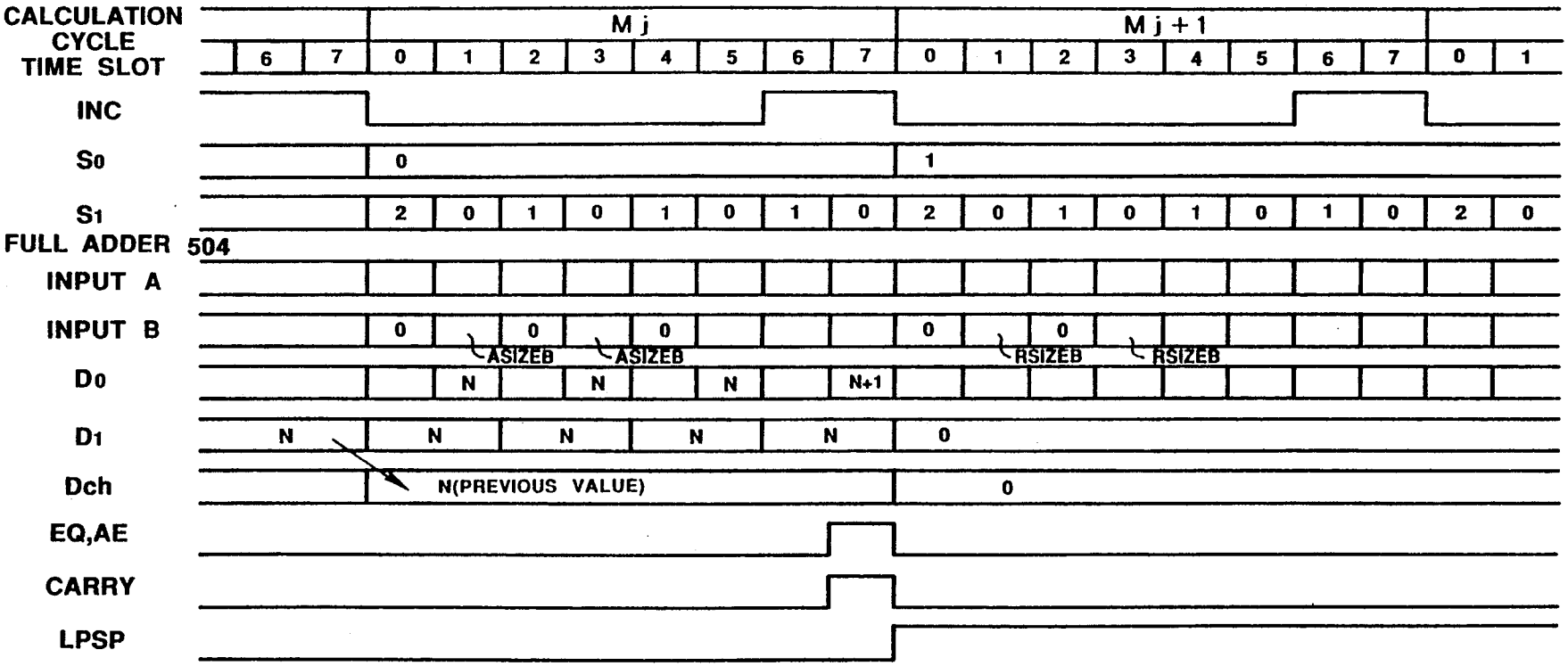

In this way, waveform readout address ADR is successively incremented and waveform readout address ADR exceeds the value of the final address of the attack portion, and reaches the lead address of the repeat portion. The operation in this case will be explained with reference to FIG. 9.

First, in the zeroth slot of a certain calculation cycle Mj, the maintenance data DCH of register 513 are set to a value n which is smaller by a value of 1 than attack size data ASIZE. At this time, when the integral part INT of the phase data has a value of 1, the addition result of full adder 504 will be n+1 (equals ASIZE) in the sixth slot, and in the seventh slot, n+1 is written into register D0 and this subtraction operation n+1−ASIZE is carried out by full adder 504. As a result of this subtraction, carry output signal CARRY is assorted and an equality detection signal EQ and an attack end detection signal AE are given a value of 1 during the period of the seventh slot by timing waveform generation circuit 902.

Then, as a result of equality detection signal EQ acquiring a value of 1 in the seventh slot, registers 512 and 513 are cleared in the zeroth slot of calculation cycle Mj+1. After this, the contents of register 512 are incremented from a value of 0 in response to the integral part INT of the phase data in the same way as above. Furthermore, from the zeroth slot of Mj+1 onward, repeat signal LPSP acquires a value of 1, and attack size data ASIZE is supplied to adder 514. Accordingly, from the zeroth slot of calculation cycle Mj+1 onward, waveform readout address ADR is incremented in the following fashion: START+ASIZE (lead address of the repeat part), START+ASIZE+1, START+ASIZE+2, . . .

Figure 10:
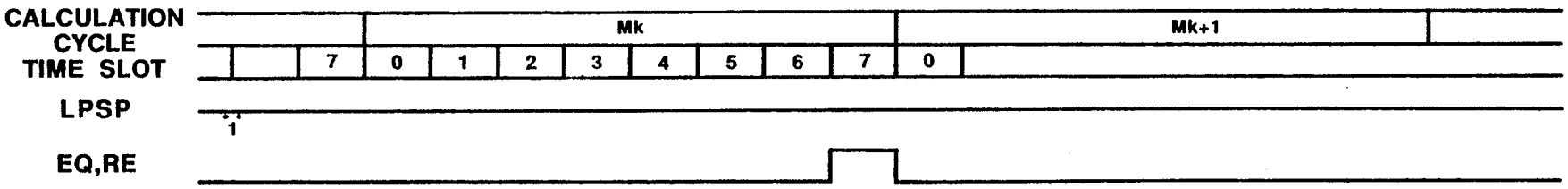

Furthermore, from calculation cycle Mj+1 onwards, select data SO acquire a value of 1 and in each odd numbered slot, data RSIZEB, comprising repeat size data RSIZE in which each bit has been inverted, is supplied to full adder 504 as receiving addition input B. Then, in each odd numbered slot, a determination is made as to whether the maintenance data D0 of register 508 at the time have reached repeat size data RSIZE or not; that is to say, in the case in which the waveform readout address ADR of the next slot has been generated based on maintenance data D0, a determination is made as to whether address ADR exceeds the final address of the repeat part or not. Then, for example, in a seventh slot of a certain calculation cycle Mk, if D0 is set equal to RSIZE, then in the seventh slot, equality detection signal EQ and repeat end detection signal RE are assorted as shown in FIG. 10. In this case, as in the case of the detection of the end of the attack part described above, register 512 and register 513 are cleared in calculation cycle Mk+1. After this, the waveform readout address is again incremented at a speed corresponding to integral part INT of the phase data in the following manner: START+ASIZE, START+ASIZE+1, START +ASIZE+2, . . .

Figure 11:
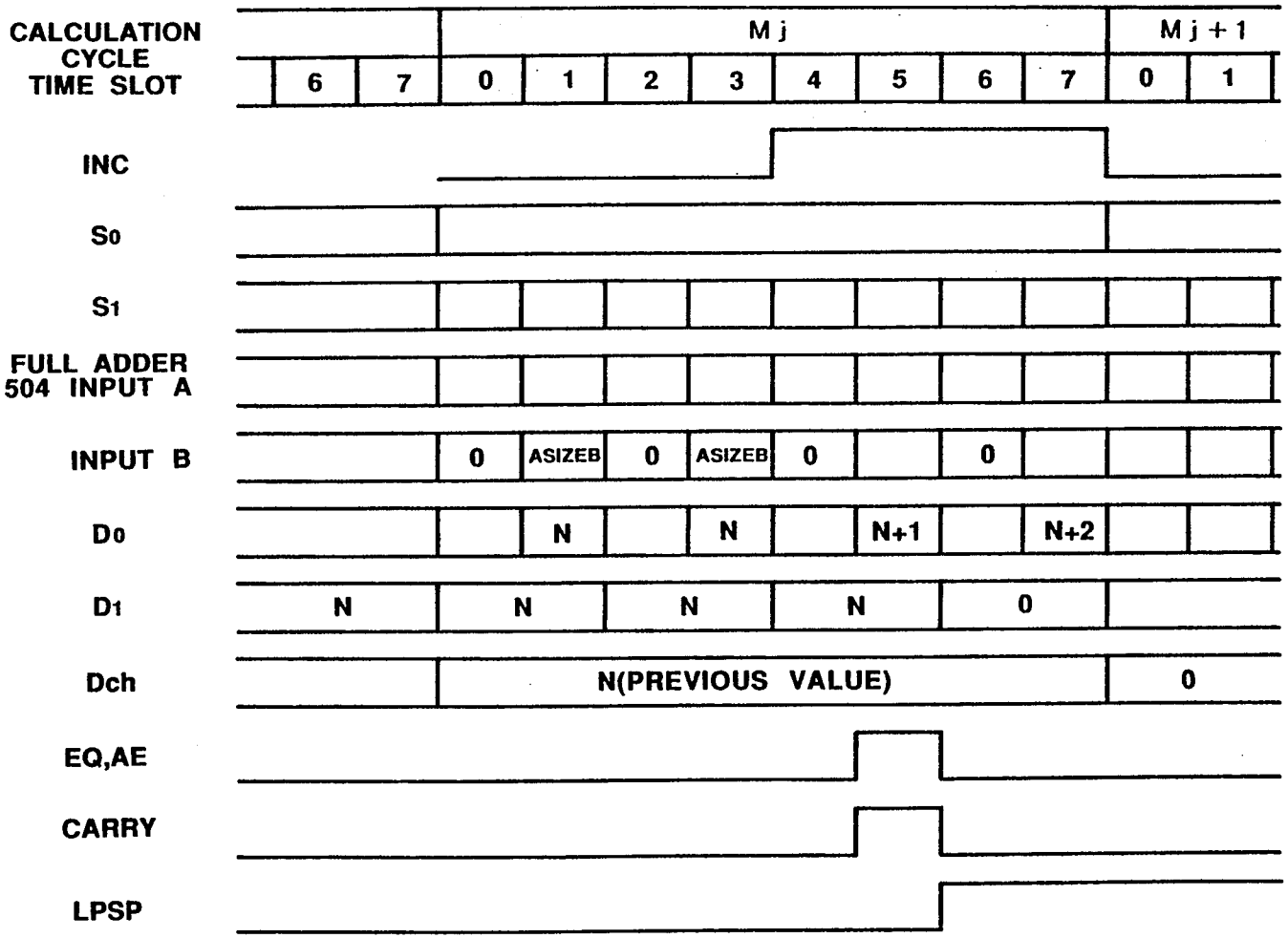

Next, the operation of the detection of the attack end will be explained in the case where integral part INT of the phase data has a value of 2. As shown in FIG. 11, in the fifth slot of a certain calculation cycle, the contents of register 508 are given a value N+1 which is equal to attack size data ASIZE. As a result, in the fifth slot, carry output signal CARRY is assorted and as a result equality detection signal EQ and attack end detection signal AE acquire values of 1. Then, in the sixth slot, register 512 is cleared and D1 acquires a value of 1. Furthermore, from the sixth slot onward, repeat signal LPSP has a value of 1. However, during the period of calculation cycle Mj, the maintenance data DCH of register 513 remain at N, and at the point of switching to a new calculation cycle Mj, maintenance data DCH acquire a value of 0.

Furthermore, the cases in which INT has a value of 3 or 4 are identical; in slots in which the equality of D0 and ASIZE is detected, signals EQ and AE are assorted, and in the following slot, repeat signal LPSP is begun, and register 512 is cleared. In a new calculation cycle which immediately follows a slot in which the equality of D0 and ASIZE is detected, register 513 is cleared. Furthermore, the operation of the detection of the end of the repeat part is identical, with the exception of the point that signal LPSP does not change.

OPERATION OF DPCM MODULATOR 7 AND INTERPOLATION CALCULATOR 8

Figure 12:
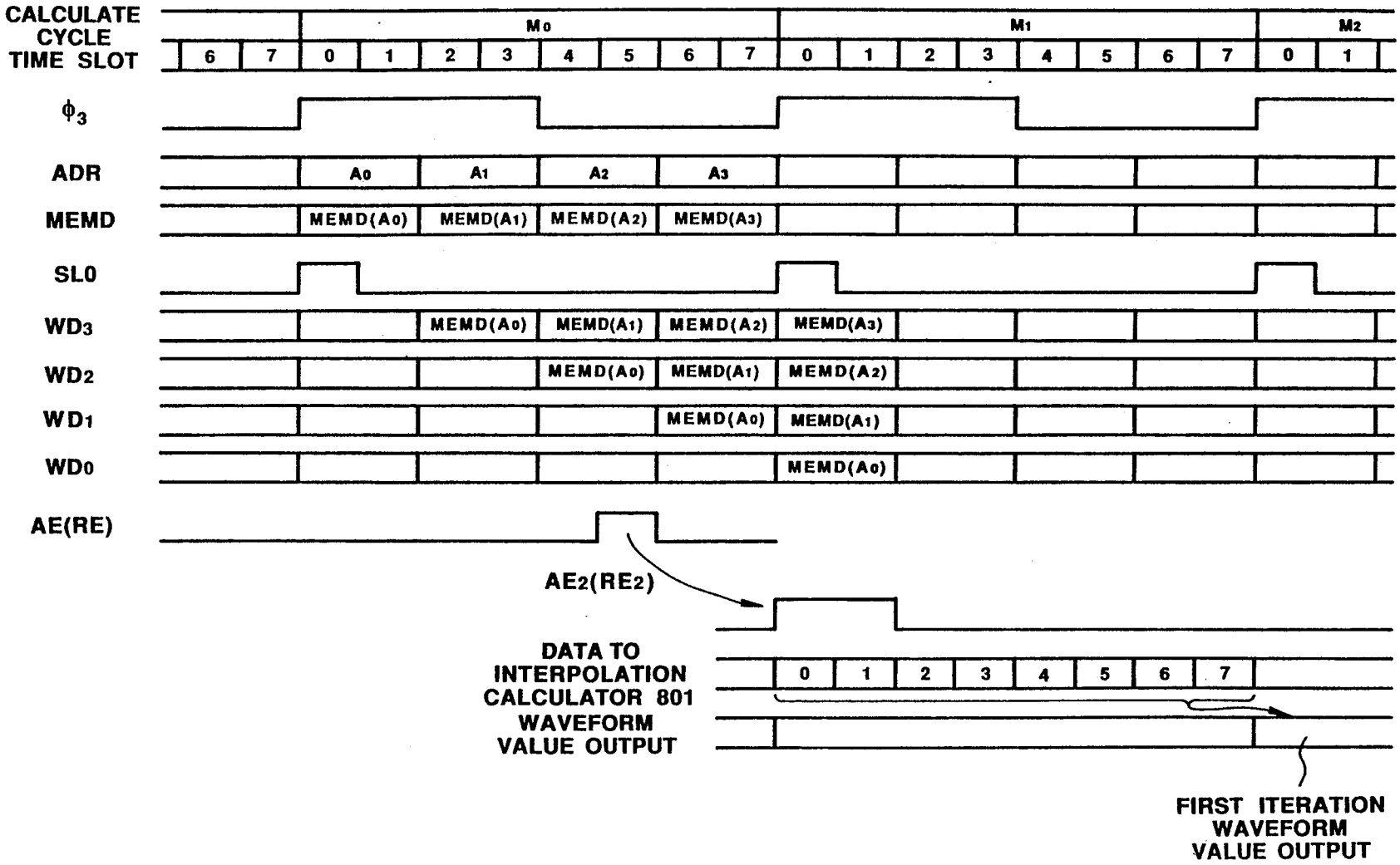
FIG. 12 illustrates data structures used for storing readout data in waveform memory and input data supplied to the DPCM the waveform generating device shown in FIG. 2.

As shown in FIG. 12, in the calculation cycle MO in the initial calculation cycle MO which follows key-on detection, 4 addresses A0 (equals START), A1 (equals START+1), A2 (equals START+2), and A3 (equals START+3) are successively generated by address generator 5 as waveform readout addresses ADR and waveform data MEMD (AO), MEMD (Al), MEMD (A2), and MEMD (A3), which correspond to these addresses, are successively read out by means of the DPCM code. These waveform data are successively registered in shift register 701 by means of clock $\phi 1a$ and shifted. Then in the zeroth slot of the next calculation cycle M1, MEMD (A0)-(A3) are registered in the fourth through first stages of shift register 701. Furthermore, the key-on pulse KONP generated in calculation cycle MO and the integral part INT of the phase data, are delayed by one calculation cycle by register 702 and register 703, and these are inputted into decoding processor 704 in calculation cycle M1. Furthermore, if attack end detection signal AE or repeat end detection signal RE have been generated, these are synchronized with clock $\phi 1b$ and registered in shift register 706 or shift register 707, respectively. Decoding processor 704 determines the output state of each stage of shift register 706 and shift register 707 in the zeroth slot of each calculation cycle, and by means of this, determines in which slot of the previous calculation cycle the attack end or the repeat end were detected. In FIG. 12, an example is shown in which the attack end detection signal AE (repeat end detection signal RE) is generated in the fifth slot, and in the zeroth slot of the following calculation cycle, detection of the fact that AE2 is equal to 1 (RE2 is equal to 1) is carried out.

The waveform data MEMD (A0)-MEMD (A3) which are registered in shift register 701 are registered in registers WD0-WD3 in decoding processor 704 by means of slot signal SLO. In calculation cycle M1, output DKONP of register 703 becomes 1, so that select data inputted into selector 711 acquire a value of 0.

Figure 13A:
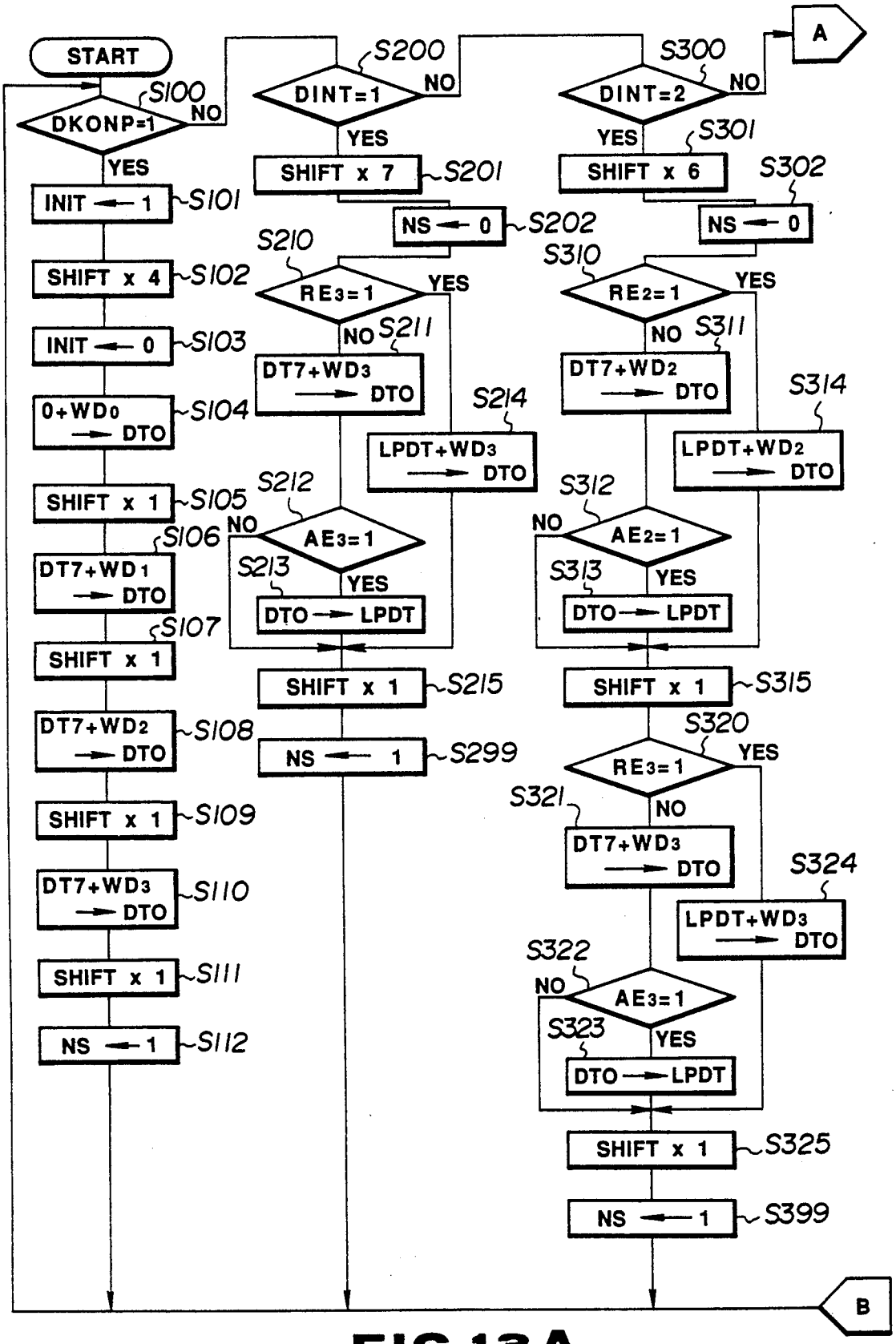
FIGS. 13A and 13B flow charts illustrating the operation of an encoding unit employed in the waveform generating device shown in FIG. 2.
Figure 13B:
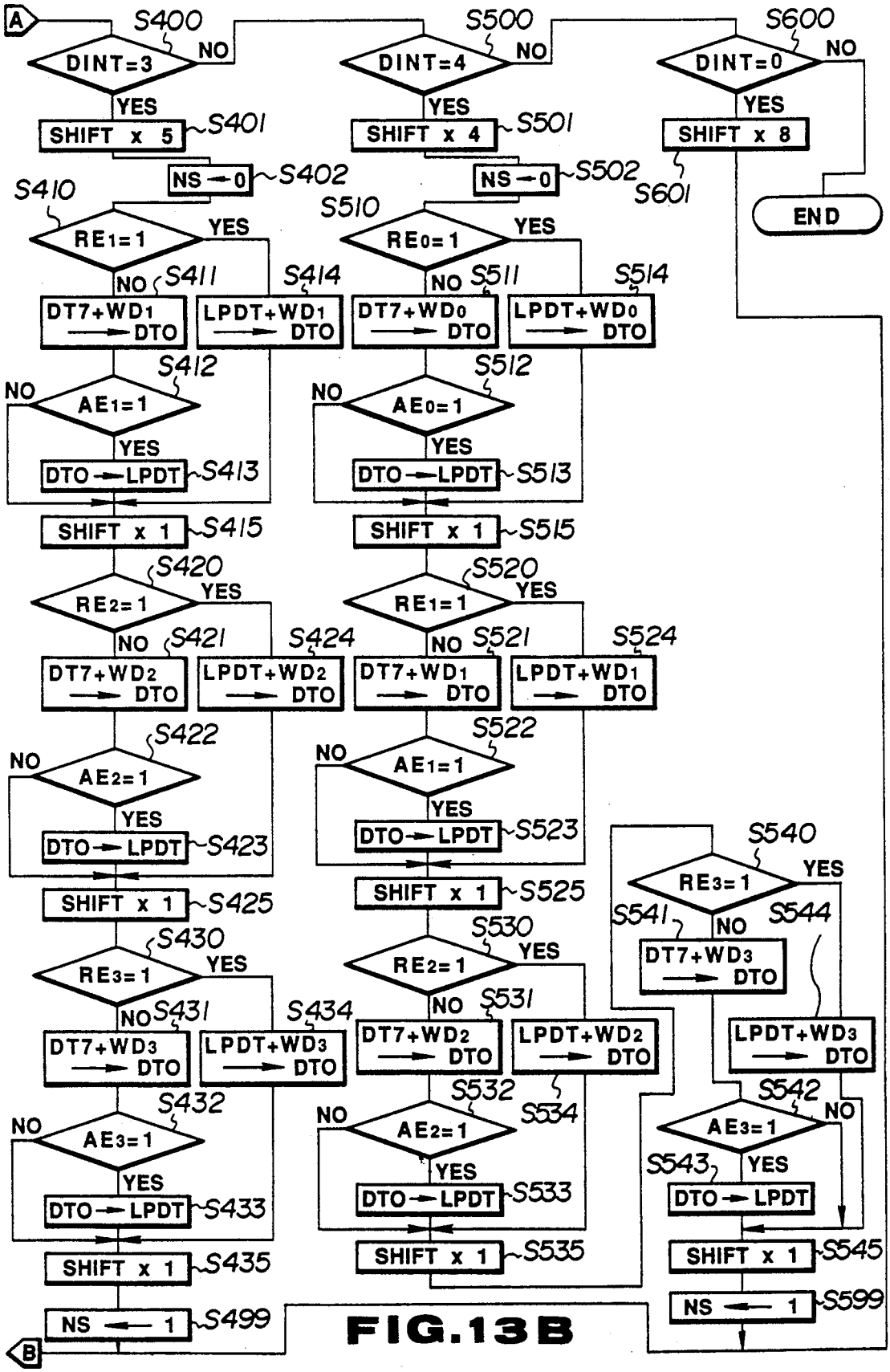

Decoding processor 704 carries out processing according to the flow chart shown in FIG. 13. Hereinafter, the operation of decoding processor 704 will be explained with reference to this flow chart. First, in step S100, a determination is made as to whether data DKONP have a value of 1 or not. If the result of this determination is "YES", step S101 is proceeded to. Initializing signal INIT acquires a value of 1 and the output of AND gate 710 becomes 0. Next, step S102 is proceeded to and 4 shift pulses SHIFT which have been synchronized with clock $\phi O$ are supplied to register 708. As a result, cyclic shifting is carried out in register 708 through the medium of the zeroth input port of selector 711, a numeric value of 0 is registered in data areas DT4 through DT7 of register 708 and 4 values of 0 are supplied to interpolation calculator 801 as interpolation calculation waveform values. Next, step S103 is proceeded to and initializing signal INIT is set to a value of 0.

Next, when step S104 is proceeded to, the first DPCM code which is stored in WD0 is added to the initial demodulation waveform value 0, and the resulting first demodulation waveform value 0+WD0 is set in data area DTO of register 708. This first demodulation waveform value 0+WD0 which is set into data area DTO is sent to interpolation calculator 801 through the medium of selector 711 and AND gate 710. Next, step S105 is proceeded to and register 708 is shifted once. As a result, the first demodulation waveform value 0+WD0 is stored in data area DT7. Furthermore, at this time, the first demodulation waveform value 0+WD0 is registered in interpolation calculator 801.

Next, when step S106 is proceeded to, the second DPCM code which is stored in register WD1 is added to the contents of data area DT7 and the resulting second demodulation waveform value 0+WD0+WD1 is stored in data area DTO. The second demodulation waveform value 0+WD0+WD1 is also, as in the case of the first value, sent to interpolation calculator 801. Next, step S107 is proceeded to and register 708 is shifted once. At this time, the second demodulation waveform value is registered in interpolation calculator 801, and registered in data area DT7. After this, identical processing is carried out with respect to the third and fourth DPCM codes stored in register WD2 and register WD3 (step S108 to step S111) and in step S112, signal NS is given a value of 1 and step S100 is returned to.

This type of processing is conducted in calculation cycle M1 and 4 waveform values of 0 and the first through the fourth demodulation waveform values are each registered in interpolation calculator 801 with timing synchronous with that of clock $\phi O$. Furthermore, in calculation cycle n1, fractional part FRAC of the phase data in calculation cycle MO is inputted into interpolation coefficient supplier 803. Then, in the calculation cycle M1, an 8-bit interpolation calculation coefficient, the 8 bits of which correspond to this fractional part FRAC, is synchronized with clock $\phi O$ and successively supplied from interpolation coefficient supplier 803 to interpolation calculator 801. Then in the calculation cycle M1, the first interpolation calculation is carried out, and the results thereof are synchronized with clock $\phi 3$ and registered in register 804 in calculation cycle M2, and then sent to the D/A converter which is connected thereto.

The contents of data areas DTO to DT7 of register 708, at the time of the end of calculation cycle M1, are shown in Table 1.

TABLE 1

| Contents of Register 708 at the End of Calculation Cycle 701 | |
|---|---|
| DATA AREA | CONTENTS |
| DT1 | 0 |
| DT1 | 0 |
| DT2 | 0 |
| DT3 | 0 |
| DT4 | WD0 |
| DT5 | WD0 + WD1 |
| DT6 | WD0 + WD1 + WD2 |
| DT7 | WD0 + WD1 + WD2 + WD3 |

From calculation cycle M1 onward, signal DKONP becomes 0 so that data DINT, that is, integral part INT of the phase data of the immediately preceding calculation cycle, is supplied to selector 711 as the select data.

Hereinbelow, the operation of DPCM demodulator 7 and interpolation calculator 8 in a calculation cycle MK following calculation cycle M2, will be explained with the assumption that the waveform shown in Table 2 below is stored in register 708.

TABLE 2

| Initial State of Register 708 | | | | | | | | |
|---|---|---|---|---|---|---|---|---|
| DATA AREA | DT0 | DT1 | DT2 | DT3 | DT4 | DT5 | DT6 | DT7 |
| INITIAL VALUE | OD0 | OD1 | OD2 | OD3 | OD4 | OD5 | OD6 | OD7 |

First, a case will be explained in which AE0 to AE3 and RE0-RE3 all have a value of 0, that is to say, the case in which there was no detection of the attack end or the repeat end in the immediately preceding calculation cycle Mk−1.

1. The Case in which DINT=0

In the zeroth slot of calculation cycle MK, the contents of each stage of shift register 701 are registered in registers WD0-WD3, and step S100 of FIG. 13 is proceeded to. In this case, the result of the decision in step S100 is "NO", so that step S200 is proceeded to. A determination is made as to whether DINT=1, and the result of this determination is "NO". In the same way, the results of the determinations in steps S300-S500 are all "NO", and step S600 is proceeded to. The determination results of step S600 is "YES" and step S601 is proceeded to, and register 708 is shifted 8 times. By means of this type of processing, a series of waveform values OD0-OD7 which is identical to that supplied in the previous calculation cycle Mk−1, is supplied again in calculation cycle MK to interpolation calculator 801.

Furthermore, the contents of register 708 do not change.

2. The case in which DINT=1

In this case, in the immediately preceding cycle Mk−1, a new DPCM code ND0 is read out of waveform memory 6 and stored in the first stage of the shift register; this DPCM code ND0 is registered in register WD3 in the zeroth slot of calculation cycle Mk. Then, in diagram 12, step S200 is proceeded to through the medium of step S100. The result of the determination in step S200 is "YES", and step S201 is proceeded to. Then, 7 shift pulses SHIFT are supplied to register 708. As a result, 7 cyclic shifts of register 708 are conducted through the medium of the first input port of selector 711 and data OD1–OD7 stored in data areas DT1–DT7, is supplied to interpolation calculator 801. Then, step S202 is proceed to and signal NS acquires a value of 0. As a result, data areas DTO are selected by selector 711.

Next, step S210 is proceeded to and a determination is made as to whether RE3=1. In this case, the results of this determination are "NO", and step S211 is proceeded to. Then, the DPCM code ND0 which is supplied this time, is added to the immediately preceding demodulation waveform value OD7 stored in data area DT7 and the addition results OD7+ND0 are stored in data area DTO as a demodulation waveform value. Next, step S212 is proceeded to. A determination is made as to whether AE3=1, and in this case, the results of this determination are "NO" and step S215 is proceeded to. Then, one shift pulse SHIFT is supplied to register 708. As a result, one cyclic shift of register 708 is carried out through the medium of the zeroth input port of selector 711. The demodulation waveform value OD7+ND0 of data area DTO is registered in interpolation calculator 801 and registered in data area DTO of register 711. Next, step S299 is proceeded to, and signal NS reacquires a value of 1, and step S100 is returned to. As a result of the carrying out of this type of processing in calculation cycle Mk, the contents of register 708 are as shown in Table 3.

TABLE 3

Contents of Register 708 at the Close of Calculation Cycle MK (in the Case in which DINT = 1)

| DATA AREA | CONTENTS |
|---|---|
| DT0 | OD1 |
| DT1 | OD2 |
| DT2 | OD3 |
| DT3 | OD4 |
| DT4 | OD5 |
| DT5 | OD6 |
| DT6 | OD7 |
| DT7 | OD7 + ND0 |

3. The Case in which DINT=2

In this case, in the immediately preceding calculation cycle MK−1, new DPCM codes ND0 and ND1 are read out from waveform memory 6 and stored in the second and the first stages of shift register 701, respectively; these DPCM codes ND0 and ND1 are registered in registers WD2 and WD3, respectively, int eh zeroth slot of calculation cycle MK. Then, in FIG. 12, step S300 is proceeded to through the medium of steps S100 and S200. The results of the determination of this step are "YES", and step S301 is proceeded to. Then, 6 shift pulses SHIFT are supplied to register 708. As a result, the cyclic shifting of register 708 is carried out through the medium of the second input port of selector 711, and data OD2–OD7, stored in data areas DT2–DT7 are supplied to interpolation calculator 801. Then, step S302 is proceeded to and signal NS acquires a value of 0. As a result, data area DT0 is selected by selector 711.

Next, step S310 is proceeded to and a determination is made as to whether RE2=1. In this case, the result of this determination is "NO", and step S311 is proceeded to. Then, the DPCM code ND0 supplied this time is added to the immediately preceding demodulation waveform value OD7 stored in data area DT7, and this addition result OD7+ND0 is stored in data area DTO as a demodulation waveform value. Next, S312 is proceeded to and a determination is made as to whether AE2=1; in this case, the results of the determination are "NO" and step S315 is proceeded to. Then, one shift pulse SHIFT is supplied to register 708. As a result, one cyclic shift of register 708 is carried out through the medium of the zeroth input port of selector 711. Demodulation waveform value OD7+ND0 of data area DTO is registered in interpolation calculator 801 and is registered as well in data area DT7 of register 711.

Next, step S320 is proceeded to and a determination is made as to whether RE3=1. In this case, the results of the determination are "NO", and step S321 is proceeded to. Then, DPCM code ND1 supplied this time is added to the immediately preceding demodulation waveform value OD7+ND0 stored in data area DT7, and this addition result OD7+ND0+ND1 is stored in data area DTO as a demodulation waveform value. Next, step S322 is proceeded to, and a determination is made as to whether AE3=1. In this case, the result of the determination is "NO", and step S325 is proceeded to. Then, one shift pulse SHIFT is supplied to register 708. As a result, a cyclic shift of register 708 is carried out through the medium of the zeroth input port of selector 711, and the demodulation waveform value OD7+ND0+ND1 of data area DTO, is registered in interpolation calculator 801 and is also registered in data area DT7 of register 711.

Next step S399 is proceeded to, and signal NS reacquires a value of 1, and step S100 is returned to. As a result of the carrying out of this type of processing in calculation cycle MK, the contents of register 708 are as shown in Table 4.

TABLE 4

The Contents of Register 708 at the Close of Calculation Cycle MK (in the case in which DINT = 2)

| DATA AREA | CONTENTS |
|---|---|
| DT0 | OD2 |
| DT1 | OD3 |
| DT2 | OD4 |
| DT3 | OD5 |
| DT4 | OD6 |
| DT5 | OD7 |
| DT6 | OD7 + ND6 |
| DT7 | OD7 + ND0 + ND1 |

4. The Case in which DINT=3 or 4

In the case in which DINT=3, in the zeroth slot of calculation cycle MK, 3 new DPCM codes ND0, ND1, and ND2, are registered in registers WD3, WD2, and WD1. Furthermore, in the case in which DINT=4, in the zeroth slot of calculation cycle MK, 4 new DPCM codes ND0, ND1, ND2, are registered in registers WD3, WD2, and WD1. In each of these cases, processing is carried out which is identical to that of the case in which DINT=2 (steps S400-S499, and steps S500-S599).

That is, in the case in which DINT=3, the demodulation waveform values OD3-OD7 supplied to interpolation calculator 801 in calculation cycle MK−1, are again supplied (step S401) and new demodulation waveform values OD7 +ND0, OD7+ND0+ND1, OD7+ND0+ND1+ND2 are supplied (steps S415, S425, S435). Furthermore, in the case in which DINT=4, demodulation waveform values OD4-OD7 are again supplied (step S501), and new demodulation waveform values OD7+ND0, OD7+ND0+ND1, OD7+ND0+ND1+ND2, and OD7 +ND0+ND1+ND2+ND3, are supplied (steps S515, S525, S535, and S545).

OPERATION AT THE TIME OF ATTACH END DETECTION

Figure 14:
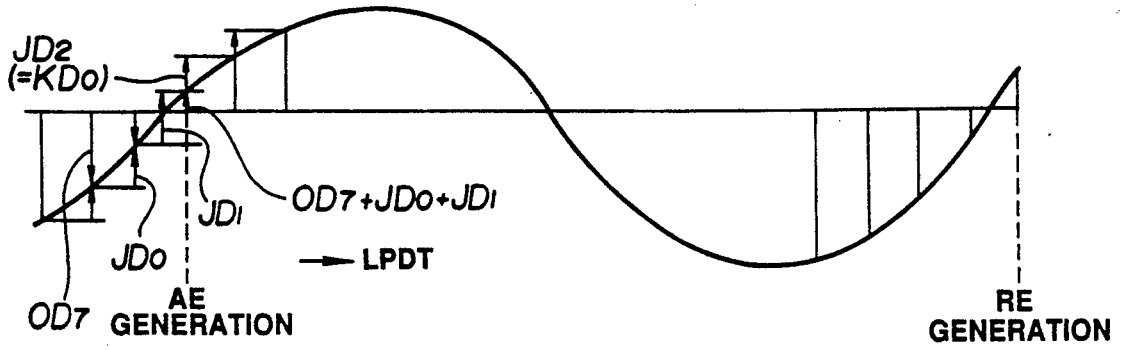
FIG. 14 is a waveform diagram illustrating operation of the encoding unit employed in the waveform generating device shown in FIG. 2 at the time of detection of the attack end and the repeat end.
Figure 15:
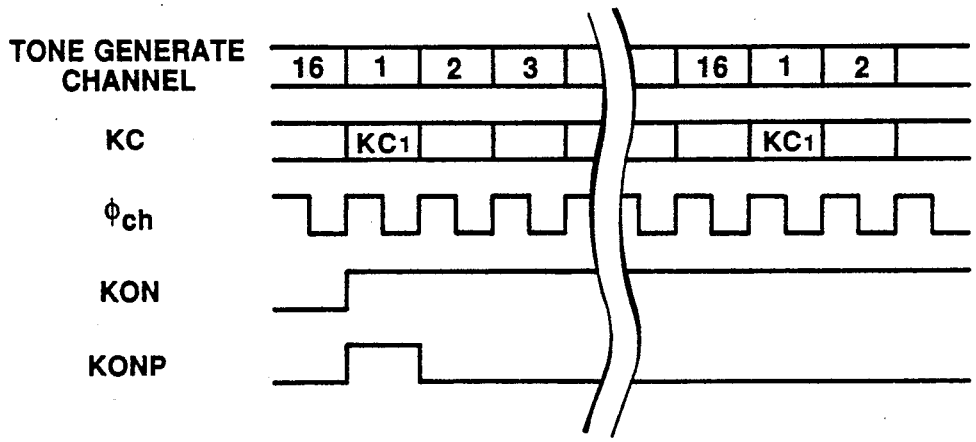
FIG. 15 illustrates a tone generating channel multiplexing method applicable to implementation of multiple tone generation capability in the waveform generating device of the present invention.

In a certain calculation cycle Mj−1, if for example, INT =3 is supplied to address generator 5, 3 waveform readout addresses are supplied from address generator 5 to waveform memory 6 and DPCM codes, for example JD0, JD1, and JD2 are successively read out of waveform memory 6. Furthermore, in the fifth slot of calculation cycle Mj−1, that is at the time of the generation of the address corresponding to DPCM code JD1, attack end detection signal AE is generated (refer to FIG. 14).

This attack end detection signal AE is registered and shifted in shift register 706 by means of clock $\phi 1b$. As a result, in the zeroth slot of calculation cycle Mj, the outputs of the fourth through first stages of shift register 706 are as follows: AEO=0, AE1=0, AE2=1, and AE3=0, respectively. Then, each of the outputs of register 707 are registered in decoding processor 704 in the zeroth slot of the calculation cycle Mj. Furthermore, in calculation cycle Mj, DINT has a value of 3, and in the zeroth slot, DPCM codes JD0, JD1, and JD2 are registered in registers WD3, WD2 and WD1.

Then, in FIG. 12, step S400 is proceeded to through the medium of steps S100-S300, and the result of this determination is "YES", and step S401 is proceeded to. Then, in the same way as above, the 5 demodulation waveform values supplied to interpolation calculator 801 in the immediately preceding calculation cycle Mj−1 are again supplied to interpolation calculator 801 (step S401). Next, demodulation waveform value OD7+JD0 is calculated using DPCM code JD0 stored in register WD1 (step S411), and this demodulation waveform value is supplied to interpolation calculator 801 (step S415). Then, demodulation waveform value OD7+JD0 +JD1 is calculated using DPCM code JD1 stored in register WD2 (step S421), and after this, step S422 is proceeded to. The result of the determination thereof is "YES", and step S423 is proceeded to. Then, the demodulation waveform value OD7+JD0+JD1 shown in FIG. 13, is stored in the loop data register LPDT. Then, the processing after step S425 is carried out.

After this, in a certain calculation cycle Mk−1, INT=3, and 3 waveform readout addresses are supplied to waveform memory 6 from address generator 5; DPCM codes, for example, KD0, KD1, and KD2 are successively readout from waveform memory 6, and in the third slot, that is, at the time of the generation of the address corresponding to DPCM code KD0, repeat end detection signal RE is generated (see FIG. 13).

This repeat end detection signal RE is registered and shifted in shift register 707 by means of clock $\phi 1b$. As a result, in the zeroth slot of calculation cycle MK, the outputs of the fourth through first stages of shift register 707 are as follows: RE0=0, RE1=1, RE2=0, and RE3=0, respectively. Then, each of these outputs and each of the outputs of register 706 are registered in decoding processor 704 in the zeroth slot of calculation cycle MK. Furthermore, in calculation cycle MK, DINT=3, and in the zeroth slot, DPCM codes KD0, KD1, and KD2 are registered in registers WD3, WD2, and WD1.

Then, in FIG. 12, step S400 is proceeded to through the medium of steps S100-S300. The result of the determination of this step is "YES", and step S401 is proceeded to. Then, in the same way as the above, the five demodulation waveform values supplied to interpolation calculator 801 in the previous calculation cycle MK−1 are again supplied to interpolation calculator 801 (step S401). Next, step S410 is proceeded to and a determination is made as to whether RE1=1. In this case, the results of this determination are "YES", and step S414 is proceeded to. Next, the DPCM code KD0 stored in register WD1 is added to the demodulation waveform value OD7+JD0+JD1 stored in loop data register LPDT, and the demodulation waveform value OD7+JD0+JD1+KD0 obtained as a result of this is stored in data areas DTO. Here, the DPCM code JD2 of the time at which attack end detection is conducted, is sent as DPCM code KD0, so that a demodulation waveform value is obtained which is identical to that of the time at which the demodulation waveform value of the beginning of the repeat part was initially calculated. Next, this demodulation waveform value is supplied to interpolation calculator 801 (step S415) and the processing after step S420 is carried out.

In this way, the demodulation waveform value at the time of the detection of the attack end is stored, and the DPCM code is added to the stored demodulation waveform value at the time of the detection of the repeat end so that the waveform of the repeat part is generated in a sure and certain manner. In cases in which the value of INT is not 3, or in cases in which the detection of the attack end and the repeat end is conducted at a timing different from that of the above, processing identical to that of the above is carried out, and the waveform of the repeat part is generated in a sure and certain manner.

SECOND PREFERRED EMBODIMENT

In the first preferred embodiment above, a waveform generating apparatus was explained in the case in which a monophonic tone was generated. In contrast, in the second preferred embodiment, a waveform generation apparatus is realized which can generate polyphonic tones. In this case, the register 406 in phase data generator 4, the register 513 in address generator 5, the registers 702 and 703 in DPCM demodulator 7, and the register 802 in interpolation calculator 8, all comprise shift registers having identical numbers of tone generation channels and stages. In this type of composition, the data shift of each shift register is carried out by means of a clock $\phi ch$ which is synchronized with the switching timing of the tone generation channels. Furthermore, the management of the vacant state of each tone generation channel is conducted; for example, if the first tone generation channel is in a vacant state when the key corresponding to key code KC1 is pressed, the management of the key codes of the tone generation channel units is carried out so that key code KC1 is supplied to frequency data generator 2 in the first musical tone generation channel.

THIRD PREFERRED EMBODIMENT

In the first preferred embodiment above, the case in which the DPCM codes were recorded in waveform memory 6 was explained; however, in place of this, it is permissible to use differing encoding formulas in the attack part and in the repeat part. For example, with regard to the attack part, which demands high fidelity waveform generation in order to produce the characteristics of the timbre (tone color), PCM codes of the waveform data are stored in waveform memory 6, while with respect to the repeat part, it is permissible to store these values encoded into DPCM codes in waveform memory 6. Furthermore, it is acceptable to make the encoding method freely selectable at the time of recording. At the time of the recording of a waveform value WP in waveform memory 6, it is possible to use a recording according to which waveform data are recorded as the upper and lower bits of a single word.

FOURTH PREFERRED EMBODIMENT

In the first preferred embodiment above, a case incorporating eighth order interpolation was explained, however, this does not mean a restriction in the number of the order of interpolation. It is acceptable to change the number of the order of interpolation with respect to the pitch. Furthermore, the method for the compression of the waveform data is not limited to the DPCM codes above; it is possible to realize an increased dynamic range by utilizing other compression techniques.

Furthermore, in the first preferred embodiment, a case was explained in which the present invention was realized by means of hardware, however, it is acceptable to realize the present invention by means of software processing instead.

Furthermore, in the first preferred embodiment, a case was explained in which repeat regeneration was conducted, however, it is also acceptable to not conduct repeat regeneration, but rather to conduct one shot regeneration.

What is claimed is:

1. A waveform generating device, comprising:

storing means for storing sampled waveform data, said data comprising samples of a waveform obtained at a predetermined fundamental sampling rate, pitch designation means for outputting a pitch signal indicating the pitch of a musical tone to be generated, readout means for reading selected samples of said waveform data at a first speed, said readout means including address generating means for generating addresses for the storing means that are determined based on the pitch signal, interpolation means for calculating intermediate data between two sample data consecutively read out by said readout means and for outputting said intermediate data at a predetermined sampling cycle, said intermediate data corresponding to hypothetical sample values of said waveform corresponding to a regeneration sampling rate different from the predetermined sampling rate, beginning readout designation means for designating the beginning of readout by said readout means, and readout speed control means for setting the speed of said readout means to a second speed for a predetermined period following the designation of the beginning of readout by said beginning readout designation means, to quickly obtain sample data necessary for the interpolation calculation and thereby reduce a time lag between the designation of the beginning of readout and the outputting of said intermediate data.

2. A waveform generating device in accordance with claim 1, in which said predetermined period is one sampling cycle.

3. A waveform generating device in accordance with claim 1, in which said interpolation means contains a plurality of delaying means and based on the delay periods of said delaying means said predetermined period is determined.

4. A waveform generating device in accordance with claim 1, in which a highest speed at which the sample data can be read, corresponding to a highest clock speed employed in the device, is used as said second speed.

5. A waveform generating device in accordance with claim 1, in which said pitch signal comprises an integral part and a fractional part, the integral part being employed by said address generating means in generating addresses of stored waveform data and being set to a predetermined value during said predetermined period, and the fractional part being employed in the calculation of intermediate data by said interpolation means.

6. A waveform generating device in accordance with claim 5, in which said predetermined period is one sampling cycle.

7. A waveform generating device in accordance with claim 5, in which said interpolation means contains a plurality of delaying means and based on the delay periods of said delaying means said predetermined period is determined.

8. A waveform generating device in accordance with claim 5, in which a highest value at which the sample data can be read, corresponding to a highest clock speed employed in the device, is used as said predetermined value.

9. A waveform generating device in accordance with claim 5, in which said interpolation means contains a plurality of delaying means and based on the delay periods of said delaying means said predetermined period is determined, and in which a highest value at which the sample data can be, corresponding to a highest clock speed employed in the device, read is used as the predetermined value.

10. A waveform generating device in accordance with claim 1, in which said interpolation means contains a plurality of delaying means and based on the delay periods of said delaying means said predetermined period is determined, and in which a highest speed at which the sample data can be read, corresponding to a highest clock speed employed in the device, is used as the second speed.

11. A waveform generating device, comprising: storing means for storing sampled waveform data, said data comprising samples of a fundamental waveform, pitch designation means for generating a pitch signal indicating the pitch of a musical tone to be generated, readout means for reading said waveform data at a first speed, said readout means including address generating means for generating addresses for the storing means that are determined based on the pitch signal, interpolation means for calculating intermediate data between two sample data consecutively read out by said readout means and for outputting said intermediate data at a predetermined sampling cycle, said intermediate data corresponding to hypothetical sample values of said waveform at a regeneration sampling rate different from the predetermined fundamental sampling rate, beginning readout designation means for designating the beginning of readout by said readout means, and readout speed control means for setting the speed of said readout means to a second speed higher than the first speed during a time interval beginning at the designation of the beginning of readout by said beginning readout designation means and continuing until a predetermined number of samples have been read out by said readout means, to quickly obtain sample data necessary for the interpolation calculation and thereby reduce a time lag between the designation of the beginning of readout and the outputting of said intermediate data.

12. A waveform generating device in accordance with claim 11 in which said interpolation means includes a delaying means having a plurality of delay stages and in which said predetermined number of samples is determined based on the number of said delay stages.

13. A waveform generating device in accordance with claim 12 in which said predetermined number of samples is less than or equal to one half the number of said delay stages.

14. A waveform generating device in accordance with claim 11, in which said pitch signal comprises an integral part and a fractional part, the integral part being employed by said address generating means in generating addresses of stored waveform data and being set to a predetermined value during said predetermined period, and the fractional part being employed in the calculation of intermediate data by said interpolation means.

15. A waveform generating device in accordance with claim 14, in which a highest value at which all the sample data can be read, corresponding to a highest clock speed employed in the device, is used as the predetermined value.

16. A waveform generating device in accordance with claim 11 in which the interpolation means includes a delaying means having a plurality of delay stages, and in which said predetermined number of samples is less than or equal to one half the number of said multiple delay stages.

17. A waveform generating device in accordance with claim 11 in which the interpolation means includes a delaying means having a plurality of delay stages, and in which said predetermined number of samples is less than or equal to one half the number of said delay stages, said pitch signal comprises an integral part and a fractional part, the integral part being employed by said address generating means in generating addresses of stored waveform data and being set to a predetermined value during said predetermined period, and the fractional part being employed in the calculation of intermediate data by said interpolation means.

18. A waveform generating device, comprising:

first storing means for storing samples waveform data, said data comprising samples of a fundamental waveform that have been encoded by means of differential pulse code modulation, pitch designation means for outputting a pitch signal indicating the pitch of a musical tone to be generated, repetition designation means for generating a repetition signal corresponding to a characteristic of the musical tone to be generated, readout means for reading said waveform data out of said first storing means, including address generating means for generating addresses of samples waveform data to be read out, said addresses being based on said pitch signal, said address generating means repetitively addressing a loop portion of the waveform data, decoding means for decoding said samples and consecutively outputting decoded sample data, second storing means for storing said part of the readout decoded sample data corresponding to a header of the loop portion in a fixed sequence, interpolation means for calculating intermediate data between two consecutive decoded sample data and for outputting said intermediate data, said intermediate data corresponding to samples of said fundamental waveform at a rate of one sample per a hypothetical regeneration sampling interval based on the pitch of the musical tone to be generated, and loop repetition means for reading successive values of decoded loop header sample data out of said second storing means and outputting said decoded sample data to said interpolation means to be used for interpolation of intermediate data between sample data located near an end of said loop portion for a number of repetitions based on said repetition signal.

* * * * *